US006094116A

United States Patent [19]

Tai et al.

[11] Patent Number: 6,094,116

[45] **Date of Patent: *Jul. 25, 2000**

[54] MICRO-ELECTROMECHANICAL RELAYS

[75] Inventors: Yu-Chong Tai; John A. Wright, both of Pasadena, Calif.

[73] Assignee: California Institute of Technology, Pasadena, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,800

[22] Filed: Aug. 1, 1996

Related U.S. Application Data

[60] Provisional application No. 60/001,812, Aug. 1, 1995.

[51] Int. Cl.[7] ..... H01H 51/22

[52] U.S. Cl. ..... 335/78; 257/421; 200/181

[58] Field of Search ..... 335/78–86; 257/414–467; 361/283.1–283.4, 819; 323/264; 200/181

[56] References Cited

U.S. PATENT DOCUMENTS

| | | | |
|---|---|---|---|
| 4,355,345 | 10/1982 | Franchet | 361/117 |
| 4,620,123 | 10/1986 | Farrall et al. . | |
| 4,721,986 | 1/1988 | Kinzer . | |
| 5,398,011 | 3/1995 | Kimura et al. | 335/79 |
| 5,578,976 | 11/1996 | Yao . | |
| 5,629,918 | 5/1997 | Ho et al. | 369/112 |
| 5,638,946 | 6/1997 | Zavracky | 200/181 |
| 5,724,015 | 3/1998 | Tai et al. | 335/75 |

OTHER PUBLICATIONS

Hosaka, et al., Electromagnetic Microrelays: Concepts and Fundamental Characteristics, IEEE 0–7803–0957–2/93 (1993).

*Primary Examiner*—Lincoln Donovan

*Attorney, Agent, or Firm*—Fish & Richardson P.C.

[57] ABSTRACT

A micro-electromechanical relay ("micro-relay") designed to both miniaturize and improve upon present day electromechanical relays. The micromachining fabrication process used to make the micro-relay is based upon technology originally used by integrated circuit (IC) manufacturers. In simplest terms, the preferred process consist of three steps, all performed using micromachining techniques. First, a layer of magnetic material is laid down on a substrate and patterned into a desired shape. Next, an electromagnetic coil is created adjacent this material. Finally, a second layer of very efficient magnetic material is laid down adjacent the first two layers, forming a magnetic circuit, and having a portion fashioned into a deflectable structure, such as a cantilever beam. The deflectable structure has at least a portion that is suspended over or adjacent to at least one electrical contact. In operation, current passes through the coil, causing the deflectable structure to deflect, and either make or break contact with the electrical contacts. The micro-relay includes a unique unpowered hold feature By integrating an electrostatic actuating capacitor into the micro-relay, an electrostatic force can be generated between the cantilever beam and the substrate of the micro-relay that is strong enough to hold the relay in the "ON" position. Turning the relay "OFF" requires only that the voltage be removed.

34 Claims, 43 Drawing Sheets

MICRO-ELECTROMECHANICAL RELAYS

The application claims benefit of provisional application Ser. No. 60/001,812 filed Aug. 1, 1995.

BACKGROUND OF THE INVENTION

1. Field of the Invention

This invention relates to miniature electrical relays and methods of making same using micromachining techniques.

2. Description of Related Art

Electromechanical relays are switching devices typically used to control high power devices. Such relays generally comprise two primary components—a movable conductive cantilever beam and an electromagnetic coil. When activated, the electromagnetic coil exerts a magnetic force on the beam in the same way that a magnet will pick up a nail. This causes the beam to be pulled toward the coil, down onto an electrical contact, closing the relay. In one type of structure, the beam itself acts as the second contact and a wire, passing current through the device. In a second type of structure, the beam spans two contacts, passing current only through a small portion of itself.

The strength of the magnetic force produced by the coil is a function of the material used in the device, the number of turns in the coil itself, and the amount of current passing through the coil. In a typical device, a large number of turns is used so that the current drawn by the coil is much less than the current switched by the relay.

Designed as "ideal" switches, relays are treated as short-circuits when closed and as open-circuits when open. Typical "ON" resistances are 0.5 Ω or less. When open, the switches are a physical break in the circuit, providing very high "OFF" resistance on the order of 10 MΩ or more. Because a relay is a closeable break in the wiring of a circuit, there are very few constraints as to how or where they can be used in a circuit. In contrast, circuits using solid state switches such as power transistors and MOSFETs must be designed to allow one of the terminals of the switch to be connected to one of the power rails. The "ON" and "OFF" resistances of such devices also tend to be worse by an order of magnitude or more than those of electromagnetic relays. Further, solid state relays often require large, expensive heat sinks when passing high current loads, a limitation eliminated by electromechanical relays.

Solid state relays and power transistors are small, thus allowing them to be used where space is at a premium. Micro electromechanical relays (microrelays) have been proposed as an alternative to power electronics with most of the benefits of conventional electromechanical relays but sized to fit the needs of modem electronic systems. See, for example, Hosaka et al., *Electromagnetic Microrelays: Concepts and Fundamental Characteristics,* IEEE 0-7803-0957-/93 (1993), and references cited therein.

However, prior microrelays are overly complex and difficult to manufacture. Accordingly, the present inventors have recognized that there is a need for improved designs and manufacturing techniques for microrelays.

SUMMARY OF THE INVENTION

The micro-electromechanical relay ("micro-relay") of the present invention is designed to both miniaturize and improve upon present day electromechanical relays. The micromachining fabrication process used to make the inventive micro-relay is based upon technology originally used by integrated circuit (IC) manufacturers and, other than packaging, eliminates the need for expensive device assembly.

In simplest terms, the preferred inventive process consist of three steps, all performed using micromachining techniques. First, a layer of magnetic material is laid down on a substrate and patterned into a desired shape. Next, an electromagnetic coil is created adjacent this material. Finally, a second layer of very efficient magnetic material (such as permalloy) is laid down adjacent the first two layers, forming a magnetic circuit, and having a portion fashioned into a deflectable structure, such as a cantilever beam. The deflectable structure has at least a portion that is suspended over or adjacent to at least one electrical contact. In operation, current passes through the coil, causing the deflectable structure to deflect, and either make or break contact with the electrical contacts.

The integrated fabrication process for the inventive micro-relay, combined with the small size of the micro-relay, makes possible a unique unpowered hold feature. The inventive micro-relay uses an electrostatic hold feature which holds the relay in the "ON" position by applying a small, zero-current voltage. By integrating an electrostatic actuating capacitor into the micro-relay, an electrostatic force can be generated between the deflectable structure and the substrate of the micro-relay that is strong enough to hold the relay in the "ON" position. Turning the relay "OFF" requires only that the voltage be removed. Since the voltage is applied to a small capacitor, negligible current is drawn for this holding function. This method removes the need for additional parts and labor during fabrication since the addition of the electrostatic actuating capacitor can be integrated into the design of the micro-relay with almost no change to the process. As an additional embodiment, the prior art technique of adding a magnet to the circuit can also be easily incorporated into the design. By changing the first layer material from a high permeability magnetic material to a permanent magnetic material, a hold relay similar to comparable commercial designs can be produced with negligible change to the process.

The benefits and improvements of the inventive micro-relay are numerous. The micromachining fabrication process permits a magnetic circuit to be incorporated into the design in an economical and practical manner. This feature can be used to either reduce fabrication complexity or operating power of the device. Because the process is based on IC manufacturing technology, miniaturization is possible. As an example of what is possible, present day electromagnetic relays of about one cubic inch can be reduced down to chips several square millimeters in area This being the case, such micro-relays can be packaged like an IC, where the packaging would dominate the ultimate size of the device. Fabrication of integrated circuits can also be integrated into the micro-relay process, permitting control circuitry to be added on a micro-relay chip. Since the "ON" resistance of the micro-relay device is potentially very low, heat dissipation and power loss due to relatively high currents is not a large constraint on miniaturization.

With reduced size, an additional benefit of the invention is a higher frequency response. The higher frequency response is a direct result of miniaturization since, as the mass of the deflectable structure becomes smaller, the speed with which it can deflect becomes faster. This can allow the device to be used in faster circuits or it can be viewed as reducing the device's "bounce" time (i.e., the length of time during switching when electrical contact between the input and output is unstable).

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings indicate like elements.

DETAILED DESCRIPTION OF THE INVENTION

Figure 1A:
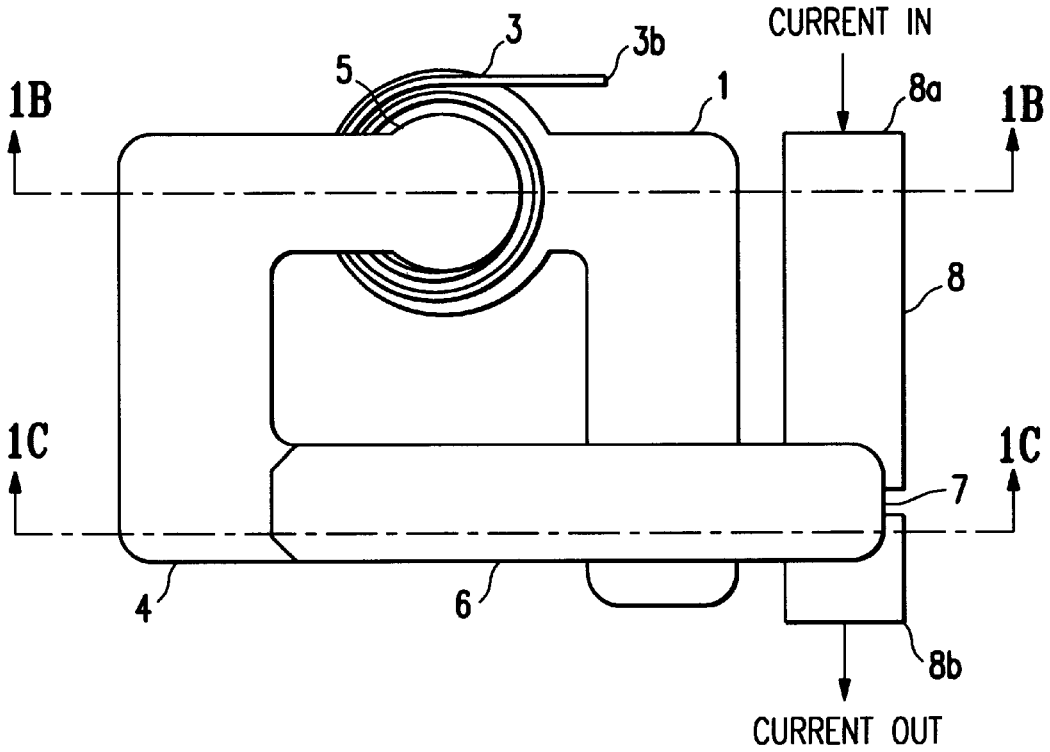
FIG. 1A is a top view of a first embodiment of a micro-relay made in accordance with the present invention.
Figure 1B:
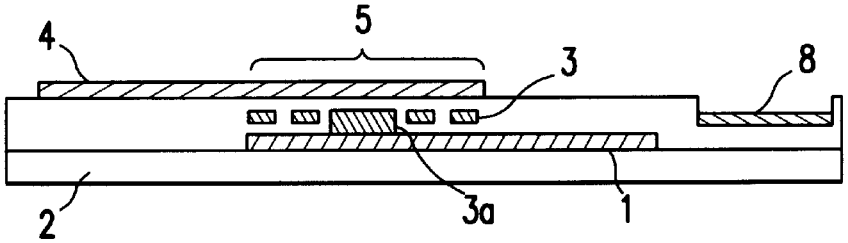
FIG. 1B is a first cross-sectional view of the micro-relay of FIG. 1A, taken along line 1B—1B of FIG. 1A.

Throughout this description, the preferred embodiment and examples shown should be considered as exemplars, rather than as limitations on the present invention.

The micro-electromechanical relay ("micro-relay") of the present invention is designed to both miniaturize and improve upon present day electromechanical relays. The micromachining fabrication process used to make the inventive micro-relay is based upon technology used by integrated circuit (IC) manufacturers and, other than packaging, eliminates the need for expensive device assembly.

The motivation for a micromachined micro-relay is two-fold. On the financial level, a simple, inexpensive fabrication process is needed to ensure the device can compete with products already on the market. On the technical level it is desired as a small and reliable relay capable of passing several amps of current. An additional benefit of using micromachining is that the circuitry used to control the latching of the relay and to provide the power for that latching can be incorporated into the device, reducing component count and assembly time and cost.

Overview of Micro-Relay Designs

The micro-relay of the present invention is fabricated by a process that is based upon micromachining technology originally used by IC manufacturers and, other than packaging, eliminates the need for expensive device assembly.

In simplest terms, the inventive process consist of three steps, resulting in a variety of equivalent structures. For example, FIGS. 1A through 4C depict several different types of structures that can be made by the present invention. Each structure features a magnetic circuit, an electromagnetic coil, and a deflectable structure, such as a cantilever beam, with at least one contact point. They differ mainly in the design of the electromagnetic coil and in the manner in which the magnetic circuit is implemented. In each design, a first layer 1 of magnetic material, such as a permanent magnet or a material having high magnetic permeability (i.e., "soft" magnetic materials such as permalloy, Sendust™, supermalloy, etc.) is laid down on a substrate 2 and patterned into a desired shape. Next, an electromagnetic coil 3 is created in magnetic circuit with this first layer 1. In the example shown, the coil 3 is spirally wound over the first layer 1. Other structures, including multiple windings and stacked windings, may be used. The ends 3*a*, 3*b* of the coil 3 are coupled to a power source (not shown). Finally, a second layer 4 of very efficient magnetic material having high magnetic permeability is laid down in magnetic circuit with the first two layers 1, 3 to complete the process.

In the preferred embodiment, the two layers of magnetic material 1, 4 overlap each other at one point 5 about which the coil 3 is wrapped. This creates a planar solenoid that is very efficient at generating magnetic force. The first layer 1 of magnetic material is included to create a magnetic circuit. By providing such a circuit, the force produced by the electromagnetic coil 3 can be concentrated at a desired point. Thus, less energy is wasted and the micro-relay becomes more efficient. Many electromagnetic relays do not employ this type of design and as such must use larger currents and a greater number of turns in their coils. However, any placement of the coil 3 with respect to the two layers of magnetic material 1, 4 may be used so long as a magnetic circuit is formed.

In the preferred embodiment, a portion of the second layer 4 of magnetic material is fashioned into a cantilever beam 6 such that the free end 7 of the beam is suspended over at least one electrical contact 8. However, any deflectable structure can be used, such as a "see-saw" pivotable beam or plate, a double-end supported beam or plate that deflects near the middle, a torsion beam, etc. For sake of example only, a cantilever beam is used in the following embodiments.

Figure 1C:
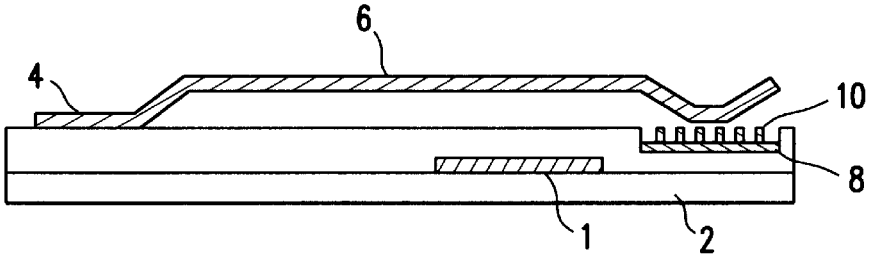
FIG. 1C is a second cross-sectional view of the micro-relay of FIG. 1A, taken along line 1C—1C of FIG. 1A.
Figure 1D:
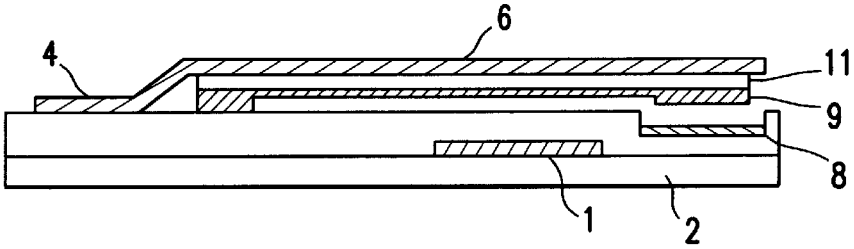
FIG. 1D is a cross-sectional view of an alternative embodiment for the micro-relay of FIG. 1A, taken along line 1D—1D of FIG. 1A.

FIGS. 1A, 1B, 1C, and 1D depict a coreless planar type structure having an input contact 8*a* and an output contact 8*b*. One end 3*a* of the planar coil 3 is coupled to a power source through the first layer 1. As noted above, more than one coil 3 may be used if desired. In operation, application of current to the coil 3 pulls the free end 7 of the cantilever beam 6 into contact with both the stationary contacts 8*a* and 8*b*. In FIG. 1C, current can either pass in either direction between contacts 8*a* and 8*b* through the free end 7 of the cantilever beam 6. If desired, the contacts 8*a* and 8*b* can be patterned with contact bumps 10 made of a conductive material, such as contact metal, as shown in FIG. 1C, to provide more reliable contact points.

This design is very straightforward because interconnects between the different layers is kept to a minimum. Because of the close proximity of the "poles" of a micromachined planar coil, the addition of a core is not expected to greatly enhance the magnetic circuit's ability to concentrate the magnetic field of the coil 3. Eliminating the core makes for easier fabrication as well as permitting the first and second layers 1, 4 of magnetic material to be electrically isolated. This allows the first layer 1 to act as one of the terminals for the coil, further reducing fabrication complexity.

Figure 1E:
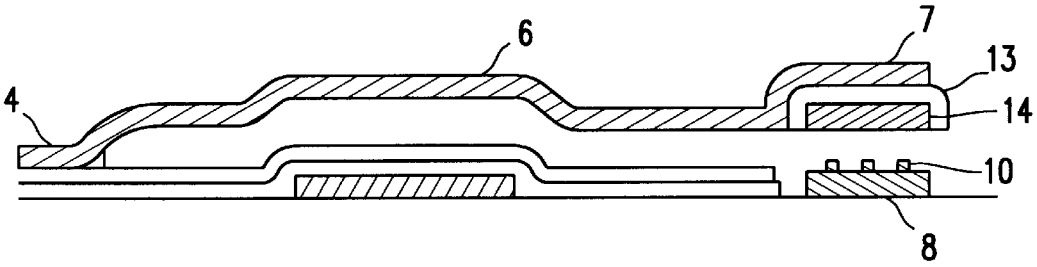
FIG. 1E is a cross-sectional side view of an alternative cantilever beam for the micro-relay of FIG. 1A.
Figure 2A:
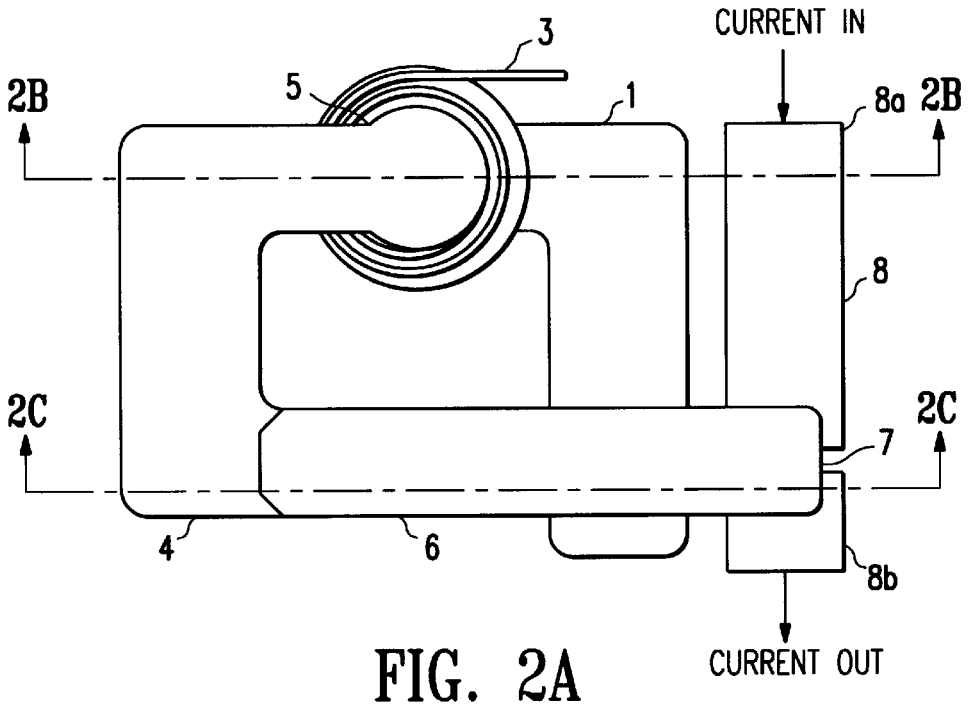
FIG. 2A is a top view of a second embodiment of a micro-relay made in accordance with the present invention.
Figure 2B:
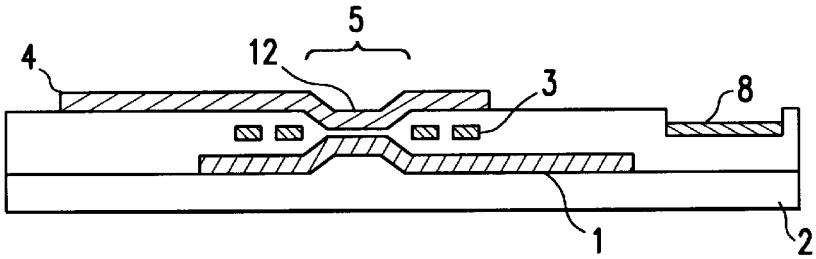
FIG. 2B is a first cross-sectional view of the micro-relay of FIG. 2A, taken along line 2B—2B of FIG. 2A.
Figure 2C:
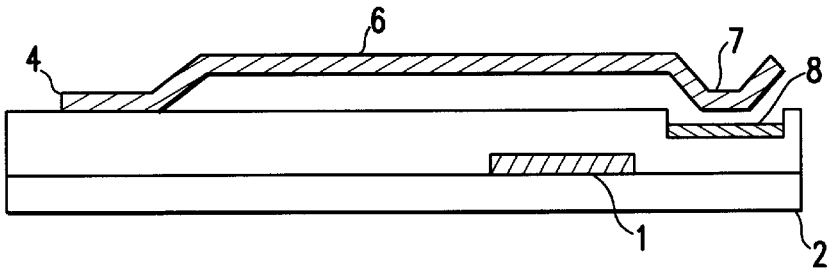
FIG. 2C is a second cross-sectional view of the micro-relay of FIG. 2A, taken along line 2C—2C of FIG. 2A.

FIGS. 2A, 2B, and 2C depict an electromagnet type structure having stationary contacts 8*a* and 8*b*. In this embodiment, one end of the second layer 4 is in electrical contact with the first layer 1 to form a solenoid core 12, with the planar coil 3 formed around the core 12. By having a core 12 of magnetic material through the interior (e.g., center) of the coil 3, the efficiency of the concentration of the magnetic field generated upon energizing the coil 3 is greater than in the design of FIG. 1A. In operation, application of current to the coil 3 pulls the free end 7 of the cantilever beam 6 into contact with both the contacts 8*a* and 8*b*. Again, current can pass between the contacts 8*a* and 8*b* through the free end 7 of the cantilever beam 6. The addition of the core makes fabrication slightly more difficult and sets constraints on the circuit in which the micro-relay can be used if the magnetic material is to be used as one of the terminals of the coil 3. However, the greater magnetic field generated by this structure means that less current is required for operation. In a variation of the structures shown in FIGS. 1C and 2C, the free end 7 of the cantilever beam 6 is coated with an insulating layer 13 and conductive contact 14, as shown in FIG. 1E. This contact 14 for the cantilever beam 6 is isolated from the magnetic circuit. Isolating the contact 14 removes most electrical restrictions on the use of the micro-relay that might be imposed if the magnetic material of the end of the cantilever beam 6 is used as part of the electrical circuit.

The integrated fabrication process for the inventive micro-relay, combined with the small size of the micro-relay, makes possible a unique unpowered hold feature. Many traditional relays require that current be constantly passed through its electromagnetic coil to maintain the relay in its "ON" position. This requirement can be eliminated by using a small permanent magnet to hold the relay in the "ON" position after being switched by the coil. A reverse coil current must then be applied to turn the device "OFF." While eliminating constant power dissipation, this feature adds complexity and cost to the device and to the controlling circuitry.

The inventive micro-relay uses an electrostatic hold feature which holds the relay in the "ON" position by applying a small, zero-current voltage. By integrating a micromachined electrostatic actuating capacitor into the micro-relay, an electrostatic force can be generated between the cantilever beam and an opposing electrode on the substrate of the micro-relay that is strong enough to hold the relay in the "ON" position. Turning the relay "OFF" requires only that the voltage be removed. Since the voltage is applied to a small capacitor, negligible current is drawn for this holding function. Not only does this reduce power consumption but also device heating. This feature is made possible by the fact that, when "ON," the micro-relay's cantilever beam 6 will be in very close proximity (about 1.0 $\mu$m or less) to the substrate. At this small distance, the electrostatic force is quite large. While an impractical several hundred volts would be required to turn the micro-relay "ON" using a capacitor, only 5 to 10 volts (and essentially no current) will be needed to hold the relay in the "ON" position. With proper design, the same voltage used to activate the electromagnetic coil 3 can be used to activate the hold electrodes. The electrostatic hold structure removes the need for additional parts and labor during fabrication since the addition of the electrostatic actuating capacitor can be integrated into the design of the micro-relay with almost no change to the process. Since a bi-directional coil current is not needed for release, controlling circuit complexity and cost is reduced.

Figure 3A:
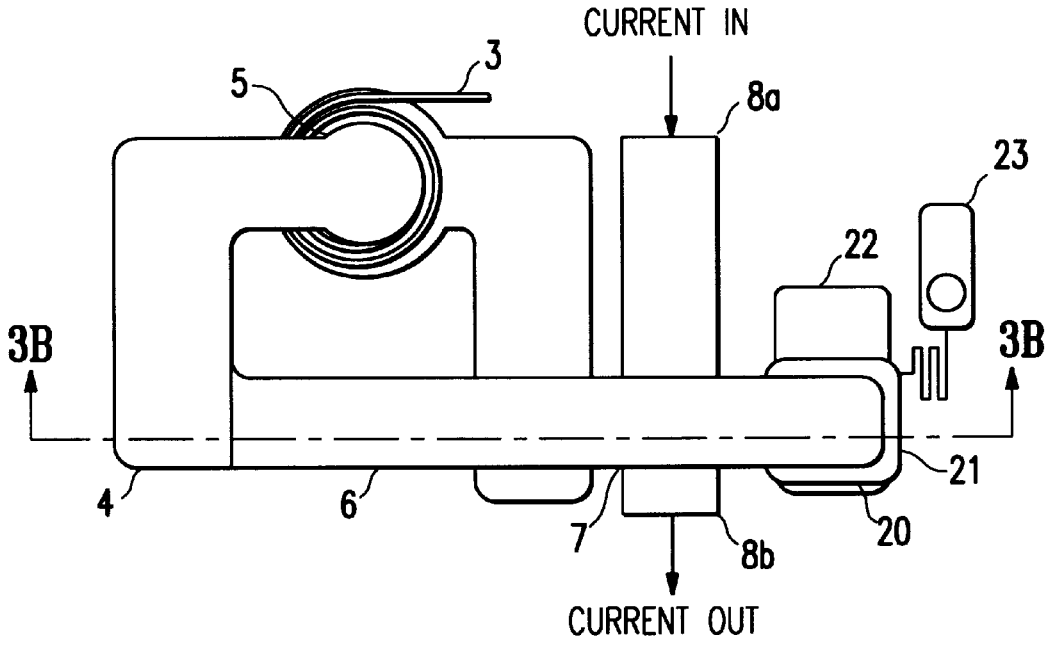
FIG. 3A is a top view of a third embodiment of a micro-relay made in accordance with the present invention.
Figure 3B:
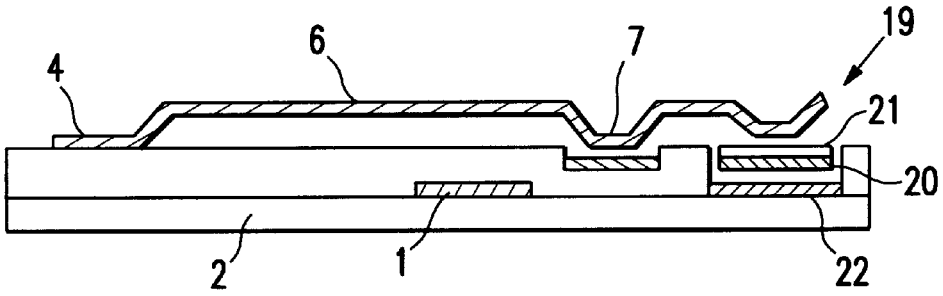
FIG. 3B is a cross-sectional view of a first embodiment for the micro-relay of FIG. 3A, taken along line 3B—3B of FIG. 3A.

FIGS. 3A and 3B depict a structure (coreless solenoid or electromagnet) that makes use of this electrostatic hold concept. In this example, the cantilever beam 6 is lengthened to form an interaction point. The interaction point includes a capacitor 19 comprising an upper holding electrode 20 separated by an insulating layer 21 from the end of the cantilever beam 6, a lower holding electrode 22, and a contact 23 coupled to the upper holding electrode 20 (e.g., by wire bond connection). Preferably, the magnetic material layers 1 and 4 are electrically isolated. In operation, application of current to the coil 3 pulls the free end 7 of the cantilever beam 6 into contact with both stationary contacts 8*a* and 8*b*. Again, current can pass between the contacts 8*a* and 8*b* through the free end 7 of the cantilever beam 6. In addition, a charge is applied across the capacitor 19. The electrostatic force generated by the capacitor 19 holds the free end 7 of the cantilever beam 6 down, in electrical contact with the contacts 8*a,* 8*b*. Since the capacitor 19 does not permit any substantial current during holding, negligible power is consumed.

Figure 3C:
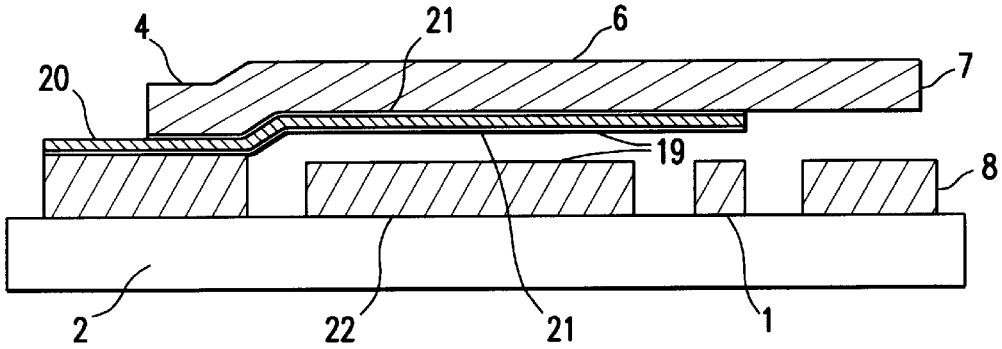
FIG. 3C is a cross-sectional view of an alternative embodiment for the micro-relay of FIG. 3A, taken along line 3B—3B of FIG. 3A.

In FIG. 3B, the capacitor 19 is shown at the very end of the cantilever beam 6, but the position of the capacitor 19 and free end 7 can be switched at the expense of some leverage, as shown in FIG. 3C. In FIG. 3C, the upper hold electrode 20 is formed along the length of the cantilever beam 6. Couplings are otherwise essentially the same as in FIGS. 3A and 3B.

Figure 3D:
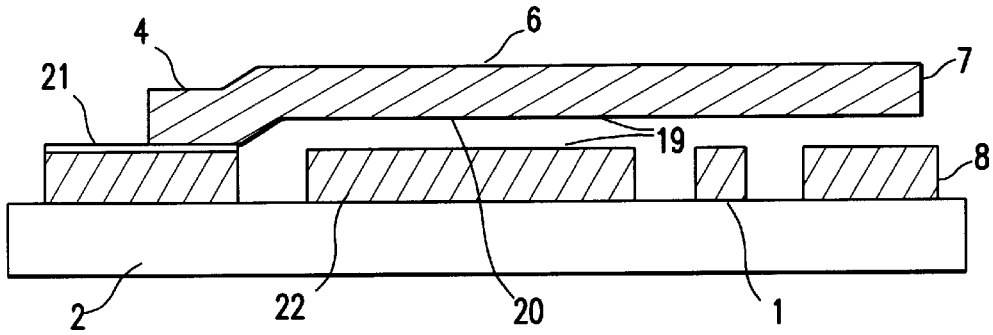
FIG. 3D is a cross-sectional view of another alternative embodiment for the micro-relay of FIG. 3A, taken along line 3B—3B of FIG. 3A.

FIG. 3D depicts an alternative structure (coreless solenoid or electromagnet) that makes use of the electrostatic hold concept. This structure is similar to that shown in FIG. 3C, but the beam 6 itself comprises the upper electrode 20 of the capacitor 19. The typical size of the cantilever beam 6 allows it to be used as a large plate electrode.

As an additional embodiment, the prior art technique of adding a magnet to the circuit can also be easily incorporated into the design. By changing the first layer material from a high permeability magnetic material to a permanent magnetic material, a hold relay comparable to commercial designs can be produced with negligible change to the process. In this embodiment, the permanent magnetic material biases the relay such that activating the coil 3 switches the relay with little force, and the permanent magnet holds the relay in the switched position. Reversing the current in the coil counteracts the permanent magnet and reverses the switching action.

Figure 4A:
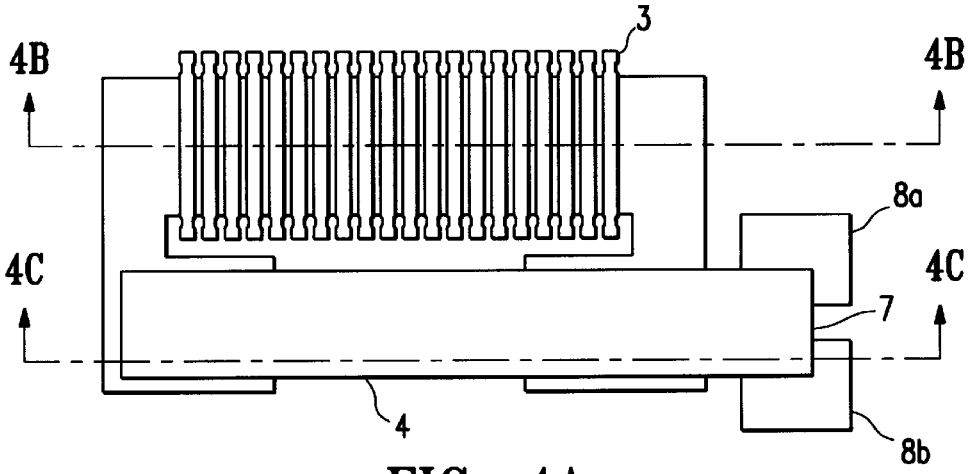
FIG. 4A is a top view of a fourth embodiment of a micro-relay made in accordance with the present invention.
Figure 4B:
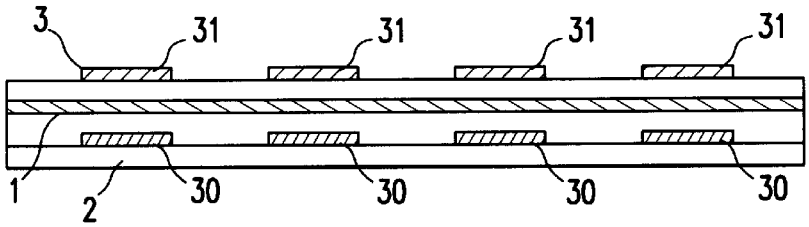
FIG. 4B is a first cross-sectional view of the micro-relay of FIG. 4A taken along line 4B—4B of FIG. 4A.
Figure 4C:
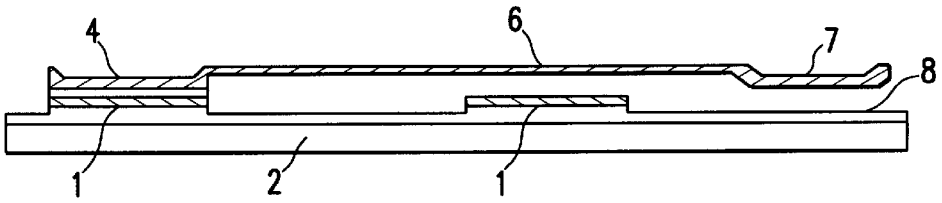
FIG. 4C is a second cross-sectional view of the micro-relay of FIG. 4A, taken along line 4C—4C of FIG. 4A.

FIGS. 4A, 4B, and 4C depict an electromagnet type structure having stationary contacts 8*a* and 8*b*. In this embodiment, the first layer 1 is changed in shape and laid over conductive traces 30 forming a bottom part of the coil 3, with conductive traces 31 forming a top part of the coil 3 laid over the first layer 1. The bottom conductive traces 30 and top conductive traces 31 are electrically cross-connected (for example, by etched and filled vias) to form at least one helical coil wrapped around a length of the magnetic material forming the first layer 1. In operation, application of current to the coil 3 pulls the free end 7 of the cantilever beam 6 into contact with both contacts 8*a* and 8*b*. Again, current can pass between the contacts 8*a* and 8*b* through the free end 7 of the cantilever beam 6. This structure is a more traditional type of solenoid relay.

The benefit of this design is that the number of turns in the coil 3 can be substantially larger than the number in a planar coil as described above. The number of turns of the coil 3, which determines the closing force, is limited mainly by the contact resistance between the coil material above and below the magnetic material core.

Figure 5A:
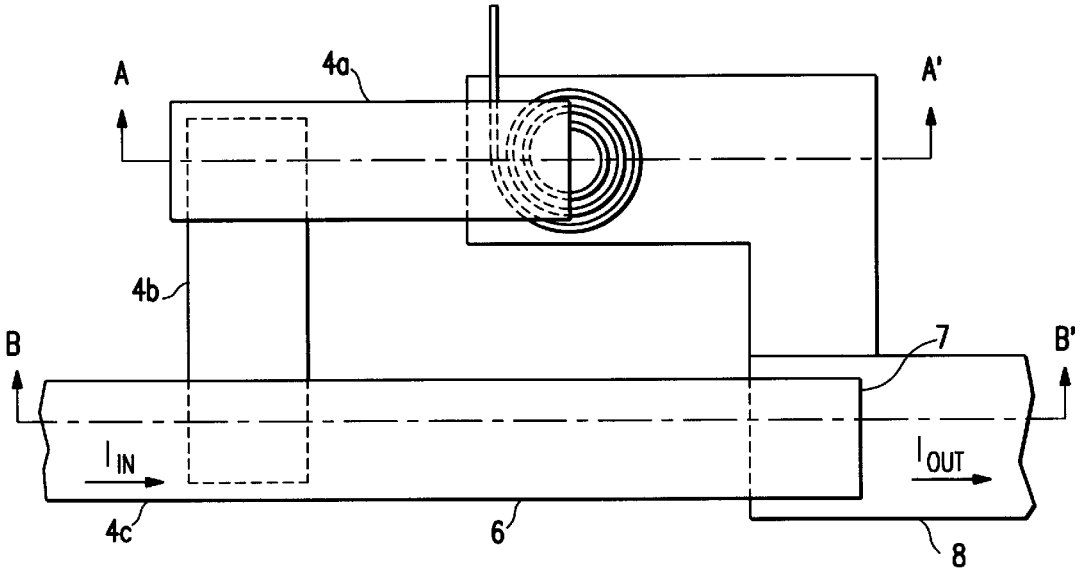
FIG. 5A is a top view of a single-contact embodiment of a micro-relay made in accordance with the present invention.
Figure 5B:
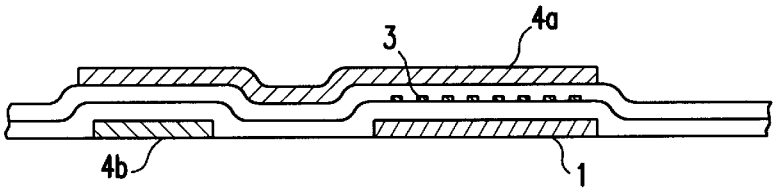
FIG. 5B is a first cross-sectional view of the micro-relay of FIG. 5A, taken along line 5B—5B of FIG. 5A.
Figure 5C:
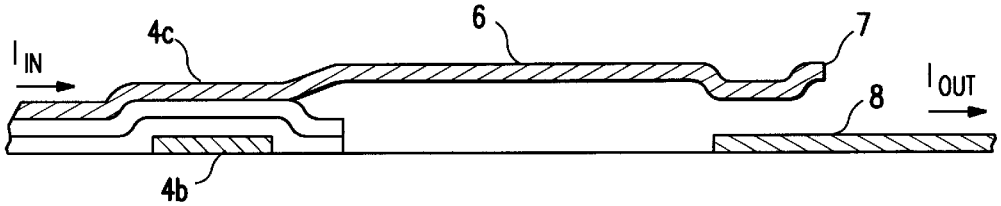
FIG. 5C is a second cross-sectional view of the micro-relay of FIG. 5A taken along line 5C—5C of FIG. 5A.

In all of the above designs, the cantilever beam 6 closes the micro-relay by its free end 7 shorting two metal contacts 8*a,* 8*b*. This general design permits the micro-relay to have the least possible "ON" resistance. However, this design also requires that two reliable contact points be created with each switching event. An alternative design uses the cantilever beam 6 to pass current in from one side of the device, to a single contact point with a contact strip 8, and out the other side of the device, as shown in FIG. 5C; the base of the beam 6 serves as the second point for electrical connection. A single contact point may make the micro-relay more reliable but may make the design of the cantilever beam 6 more critical in order to have proper performance and minimum "ON" resistance. This limitation is overcome by the design shown in FIG. 1D, in which an extra conductive arm 9 is formed under the cantilever beam 6 separated by an insulating layer 11. In this configuration, current can be conducted through the conductive arm 9 to a single contact 8; the base of the conductive arm 9 serves as the second point for electrical connection.

These alternative designs can be applied to any of the structures of FIGS. 1A–4B. However, one preferred embodiment of a single contact micro-relay is shown in FIGS. 5A, 5B, and 5C. The planar coil structure of FIG. 1A is used in general, but the second layer 4 is partitioned into three legs, 4*a,* 4*b,* 4*c,* which are electrically isolated but magnetically coupled. This design isolates the input $I_{in}$ from the output $I_{out}$ when the device is open.

Spark Suppression

A technique that may potentially extend the life of a micro-relay is the integration of spark suppression into the design. Electromechanical relays usually fail due to welding of the cantilever beam to an electrical contact. This occurs due to sparking in the gap between the beam and a contact when the relay opens and closes. The sparking is caused by the tendency of a circuit not to permit abrupt steps in current flow. When a relay switches, it generates such a step in current, typically resulting in a large voltage across the relay terminals. The large voltage causes sparking and initiates current flow which "smooths" the current step.

Several techniques can be incorporated into the inventive micro-relay which can help suppress these sparks. Because the technology used to fabricate the micro-relay is borrowed from the IC industry, conventional power diodes and transistors can be added in parallel with a relay. Such devices can be designed such that they are only active during the switching periods of the relay. Thus, they would dissipate very little power and produce very little heat. Designed correctly, they could effectively eliminating sparking.

A second method, believed to be completely unique as applied to relays, is the integration of spark gaps or micro-lightning rods into the design of the micro-relay. It is possible to produce very sharp discharge points at one terminal of a micro-relay in very close proximity to the second terminal. Acting as micro-lightning rods, the discharge points would concentrate the electric fields produced by large voltages generated during switching, creating preferential sparking points. While sparking would still occur, it would be directed away from the moving contact points, reducing the likelihood of contact welding, thereby extending the life of the device. The benefits of this technique over integrated ICs is the simplicity of fabrication and the elimination of the requirement that silicon be the substrate.

Figure 6A:
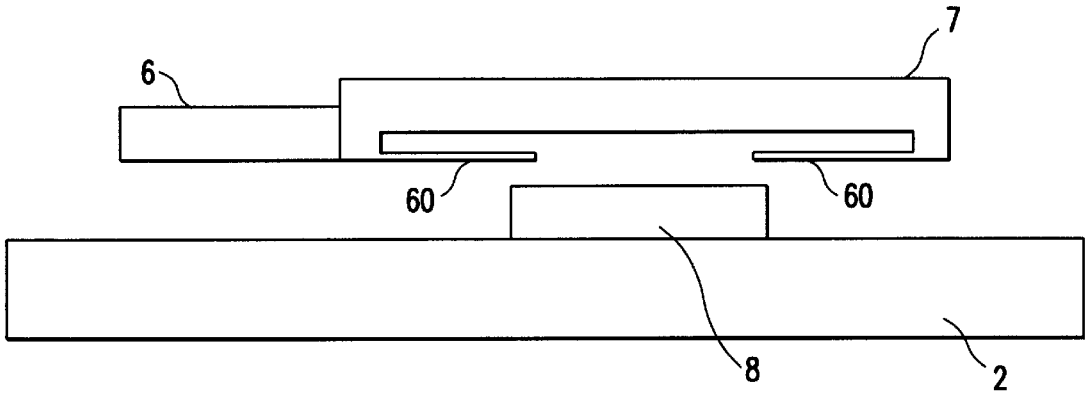
FIG. 6A shows a cross-section of a relay contact head of a micro-relay incorporating mini-lightening rods.
Figure 6B:
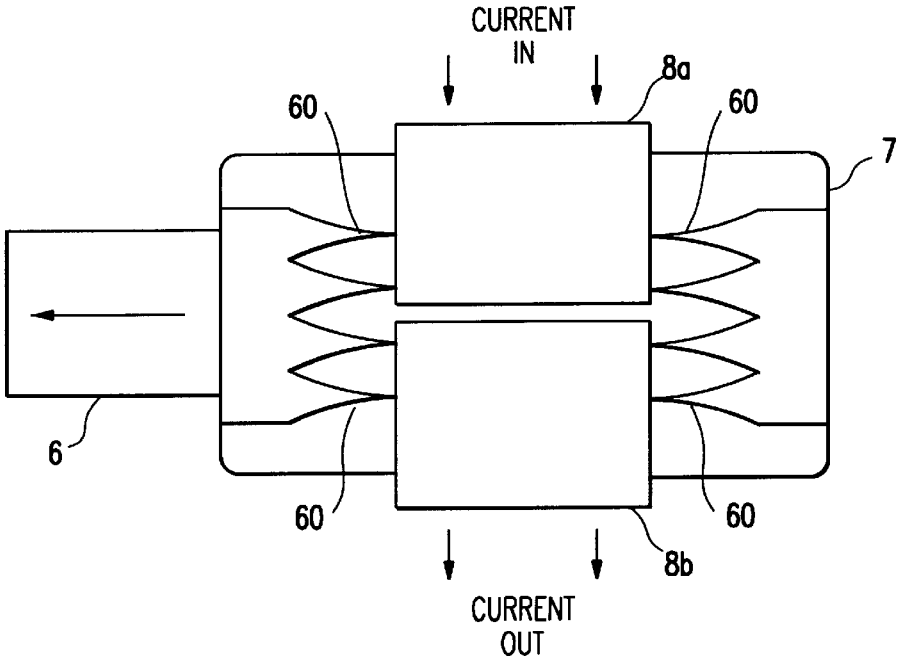
FIG. 6B is a top x-ray view of the head shown in FIG. 6A.

FIG. 6A shows a cross-section of a relay contact head of a micro-relay incorporating micro-lightening rods 60 underneath the free end 7 of a cantilever beam 6. The rods 60 may be made of the coil material, and should be rugged enough to take the discharge of approximately 10–100 times the nominal switched current. The head is poised above a contact 8. FIG. 6B is a top x-ray view of the same head. This design can be used with either single-contact or double-contact micro-relay designs. The rods 60 need not touch the contact 8, and indeed the tips of the rods 60 are preferably spaced a short distance (e.g., less than about 1 $\mu$m) from the contact 8 when the cantilever beam 6 is touching the contact 8, but sufficiently close to comprise a spark gap. That is, the rods 60 intensify the E-field at their tips and therefore are preferential regions for sparks to generate. In this embodiment, the rods 60 may even touch the contact 8 during switching.

In the preferred embodiment, the lightening rods are designed such that they have negligible stiffness so that they flex to allow the free end 7 of the cantilever beam 6 to touch the contact 8. In an alternative embodiment, the rods 60 can be configured to just touch the sides of the contact 8 and be out of the way when contact is made; thus, stiffness is irrelevant.

Figure 7:
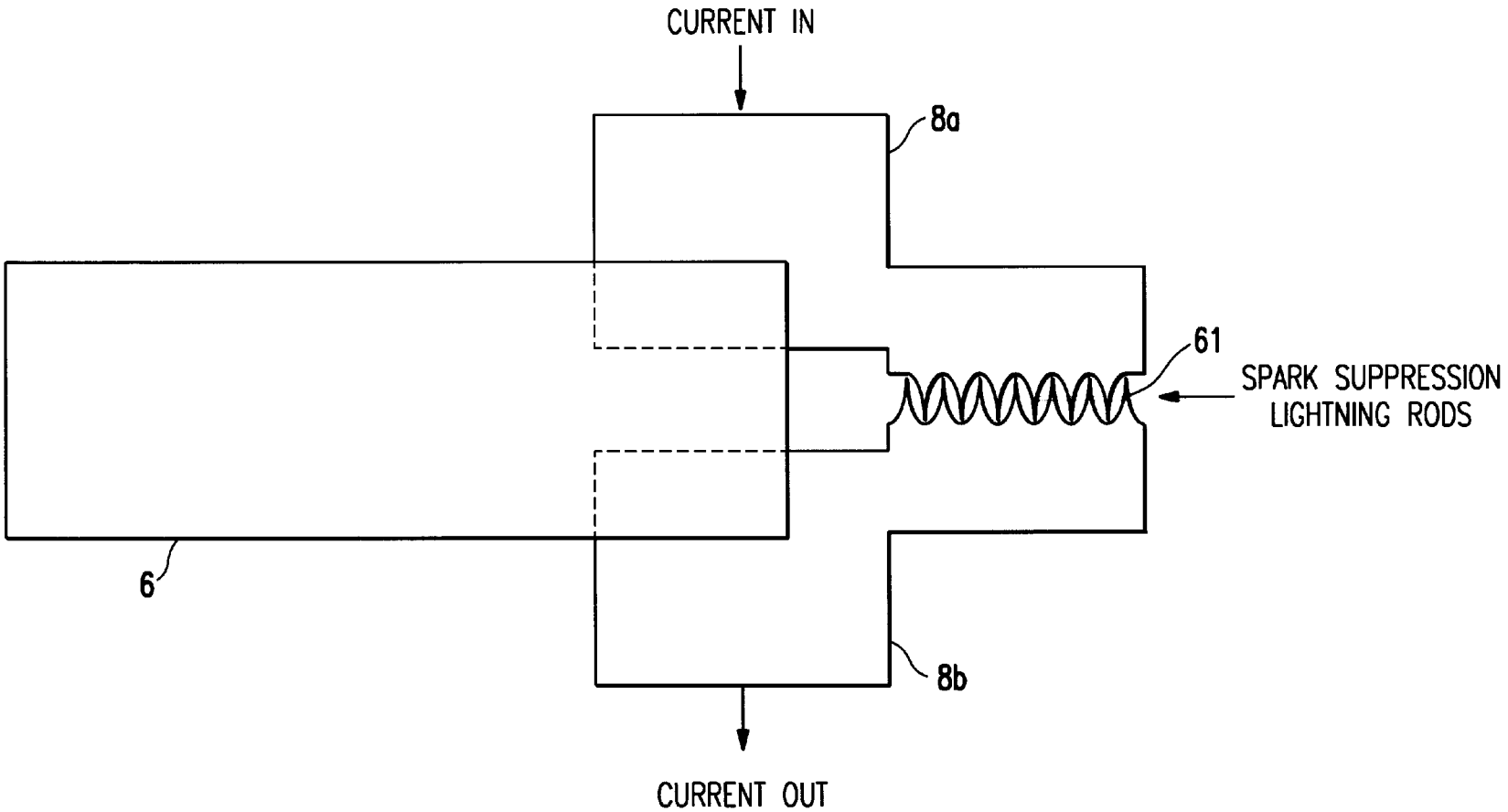
FIG. 7 is a schematic diagram of an embodiment of the present invention showing lightening rods patterned into stationary contacts.

FIG. 7 shows an embodiment of the present invention showing lightening rods 61 patterned as an extension of the stationary contacts 8*a* and 8*b*. In the illustrated embodiment, the tips of the rods 61 are separated by less than about 1 $\mu$m. The rods 61 may be of any conductive material, and may be fabricated using standard IC fabrication techniques. This design can be used with either single-contact or double-contact micro-relay designs. When the relay contact opens, sparks tend to be generated. If the sparks were generated at contact points, the life of the micro-relay would decrease. The lightening rods 61 intensify the E-field at their tips and therefore are preferential regions for sparks to generate.

Design Considerations and Calculations

A complete micro-relay comprises three main components. These are the mechanical relay itself, the actuator which opens and closes the relay, and the electronic circuitry. While this invention focuses on the first two components, the fact that the relay is fabricated using micromachining techniques allows the structure to be built on top of a previously processed silicon die which contains both control and power circuitry. Ultimately, a completely integrated system can be created to produce an intelligent, high-current load micro-relay.

As a starting design for the micro-relay, its basic geometry is chosen to be a cantilever beam structure. Preferred dimensions of the beam can be determined as follows. A conservative estimate for the current carrying capability of micromachined wires is about 10 $\mu A/\mu m^2$. Assuming the relay must be able to pass a full amp of current, then the cross sectional area of the cantilever beam would be:

$$A = 1.0\,\text{amp}\frac{\mu m^2}{10\mu A} = 100{,}000\,\mu m^2$$

For a micromachined beam, realistic dimensions that would give this area would be:

t=thickness=100 $\mu$m w=width=1,000 $\mu$m

For the remaining dimension, the length of the beam, we arbitrarily choose it to be:

L=length=3,000 $\mu$m

With the geometry determined, the force required to bend the beam needs to be calculated. For a cantilever beam it can be shown that the force required to displace its end by a distance z is:

$$F = \frac{3EI}{L^3}z \qquad \text{Eqns. (1) \& (2)}$$

$$I = \frac{wt^3}{12}$$

where:

E=modulus of elasticity=100 GPa for copper/permalloy

I=moment of inertia

A second choice of dimensions must be made here. A value for the maximum expected displacement, $z_{max}$, is needed. Again, for micromachining, a realistic value is:

$Z_{max}$=5 $\mu$m

Inserting all of the above values into equations (1) and (2) gives:

I=8.33×$10^{-17}$ $m^4$ F=4.630 mN

Now that all of the mechanical parameters of the cantilever beam have been determined or calculated, the method of actuation can be chosen. In micromachining there are two practical types of actuation: magnetic and electrostatic. The order of magnitude of force that can be generated by each type are measured in mN and $\mu$N, respectively. Therefore, magnetics appears to be the only viable method of actuation.

The most efficient magnetic design is a magnetic circuit consisting of a loop of magnetic material with a gap at the point of actuation and a solenoid to generate the magnetic flux. The magnetic loop directs and magnifies the flux generated by the solenoid through the gap where the force is generated. This force can be shown to be:

$$|F| = \frac{1}{2}(NI)^2\frac{\mu_0 A}{z^2} \qquad \text{Eqn. (3)}$$

where:

N=number of turns in the coil $I_0$=current in the coil

A=cross sectional area of the solenoid z=distance between the beam and the substrate $\mu_0$=vacuum permeability 4×$10^{-7}$ H/m The z used in this equation will be the minimum magnetic circuit gap, $Z_{min}$, when the beam is at its maximum displacement. Assuming some insulation is present in the circuit, this value will be:

$z_{max}$=5 $\mu$m

For a micromachined solenoid a typical excitation current and resulting force would be:

$I_0$=1 MA→F=0.8 m×N

So a solenoid coil with 6 turns or more will generate the necessary force. It should be noted that this number of turns is more than truly necessary, since the magnetic force will increase as the beam is drawn closer to contact.

Using a less conservative estimate for the current carrying capability of micromachined wires of about 500 $\mu$A/$\mu$m, and assuming the relay must be able to pass a full amp of current, then the cross sectional area of the cantilever beam would be:

$$A = 1.0\,\text{amp}\frac{\mu m^2}{500\mu A} = 2{,}000\ \mu m^2$$

For a micromachined beam, realistic dimensions that would give this area would be:

t=thickness=10 $\mu$m w=width=200 $\mu$m

For the remaining dimension, the length of the beam, we arbitrarily choose it to be:

L=length=500 $\mu$m

With the geometry determined, the force required to bend the beam needs to be calculated. For micromachining, a realistic value for the maximum expected displacement, $Z_{max}$, is:

$Z_{max}$=10 $\mu$m

Inserting all of the above values into equations (1) and (2) gives:

$I=16.67\times10^{-21}\ m^4$ $F=400\ \mu N$

For a micromachined solenoid a typical excitation current and resulting force, from equation (3), would be:

$F=8\times10^{-6}\times(NI_0)^2$ [Newtons]

So to generate 400 $\mu$N of force, the amount needed to counteract the mechanical force of the beam at full displacement, the product, $NI_0$, needs to be:

$NI_0 \geqq 7.07$

Choosing reasonable values for $I_0$ gives the following number to turns:

$I_0$=10 mA→N≧707 or $I_0$=100 mA→N≧71

Using the inventive processes described below, 71 turns can be fabricated in a straightforward manner, which permits a relatively small current to be used. Increasing the current reduces the number of turns needed and makes fabrication easier. If power is an issue, increasing the number of turns, while increasing fabrication difficulty slightly, will proportionately reduce the coil current.

Fabrication Processes

Included below under Examples are several alternative fabrication processes. In these examples, plating is the preferred method of depositing metal elements and magnetic circuit elements. However, any method that provides for equivalent structure can be used, such as screen printing, vapor deposition, etc.

As shown, the design requires that two distinct components be integrated into a single device. The solenoid is built from several layers of conductive material, such as metal, which are separated by insulating layers of photoresist. At the end of the process, this resist remains between the metal layers to prevent short circuits from rendering the solenoid inoperable. This is contrary to the process needed to produce the cantilever beam. Here, a two-layer metal design is used with the top layer being extremely thick.

While photoresist is used during processing to separate the layers, it is all removed in the last step to create a freestanding structure.

In order to integrate the solenoid and the beam together to create a micro-relay, care must be taken in building the two components. Inherent in the fabrication process is the creation of large, non-planar areas that will be filled by electroplated metal. Due to non-uniformity of plating thickness across the wafer and uncertainty in the plating rate, it cannot be expected that the heights of the copper and the photoresist mold will be the same. If the difference is too great, the following layer of photoresist will be unable to produce a level surface. Without a planar surface, features exposed in the subsequent resist layers become deformed. Eventually, the non-uniformity will reach a point at which the exposure will fail completely. To avoid this problem, each plating is preferably followed by planarization. This is done by first choosing a plating thickness that is thinner than that of the resist mold defining it. After plating, the resist can be globally etched back with oxygen plasma until its level is comparable to that of the electroplated metal.

To help with the planarization issue, uniformity of the copper electroplating is required. It is desirable to be able to design with arbitrarily sized plating areas, but this is problematic due to the nature of electroplating. If a large and a small area are situated next to one another, the plating rate in the small area will be noticeably larger than the rate in the large area. Also, uniform plating thickness across a wafer is difficult to attain. Finally, small grain size is desired to reduce surface roughness on the structures being created. These issues can be partially addressed by appropriate mask design but careful setup and calibration of the plating tank and solution must also be done.

The remaining area requiring careful design is the technique used to remove the photoresist from beneath the cantilever beam. The two techniques available, wet and dry release, each have their advantages and disadvantages. In the case of wet releasing, it is relatively easy to quickly strip the resist from the wafer without damaging the metal layers. Unfortunately a phenomena known as stiction occurs when the liquid dries.

Stiction causes free standing structures to be pulled to the substrate where they stick, rendering them useless. If a dry release, such as plasma ashing, is used, stiction is avoided but another difficulty arises. A dry release requires that the plasma being used be largely isotropic. This allows it to etch the sacrificial material beneath a structure and free it. For relatively small structures, say tens of microns in size, this technique works quite well. However the beam that needs to be undercut may be many hundreds of microns wide.

Accordingly, the following examples provide a workable but not necessarily perfect method of fabricating the micro-relays in accordance with the present invention.

Examples

Abbreviations:

PI=polyimide

Cr=chrome

Cu=copper

PR=photoresist

RIE=reactive ion etch

HNA=isotropic Si etchant

AZ4620=brand of PR

NiFe=permalloy soft bake=bake at ~90° C.

hard bake=bake at ~12° C.

ultra bake=bake at ~180° C.

A. First Process

Figures 8A, 8B, 8C, 8D, 8E:
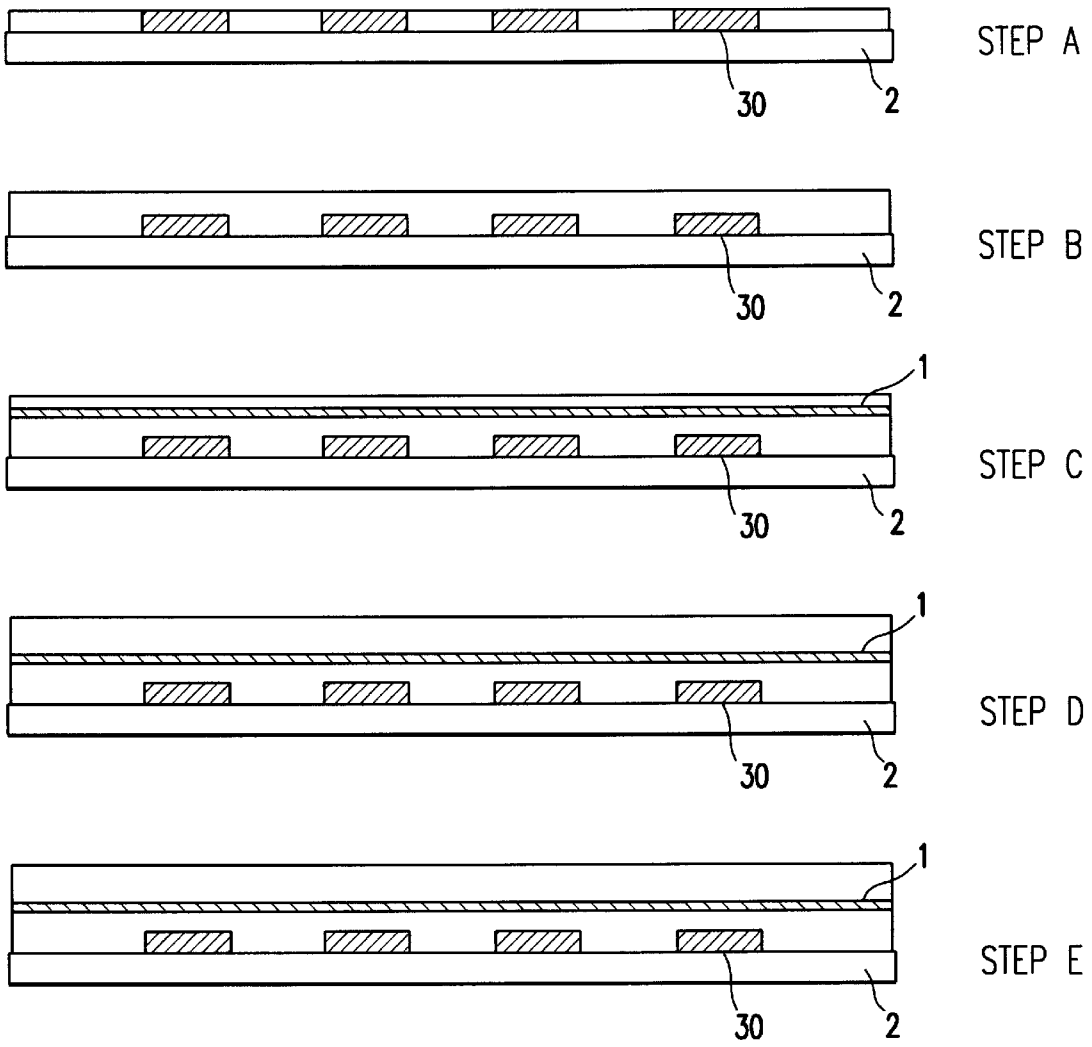
FIG. 8 is a cross-sectional view of the preferred fabrication stages for the embodiment of the present invention shown in FIG. 4A, taken along line 4B—4B of FIG. 4A.
Figures 8F, 8G, 8H:
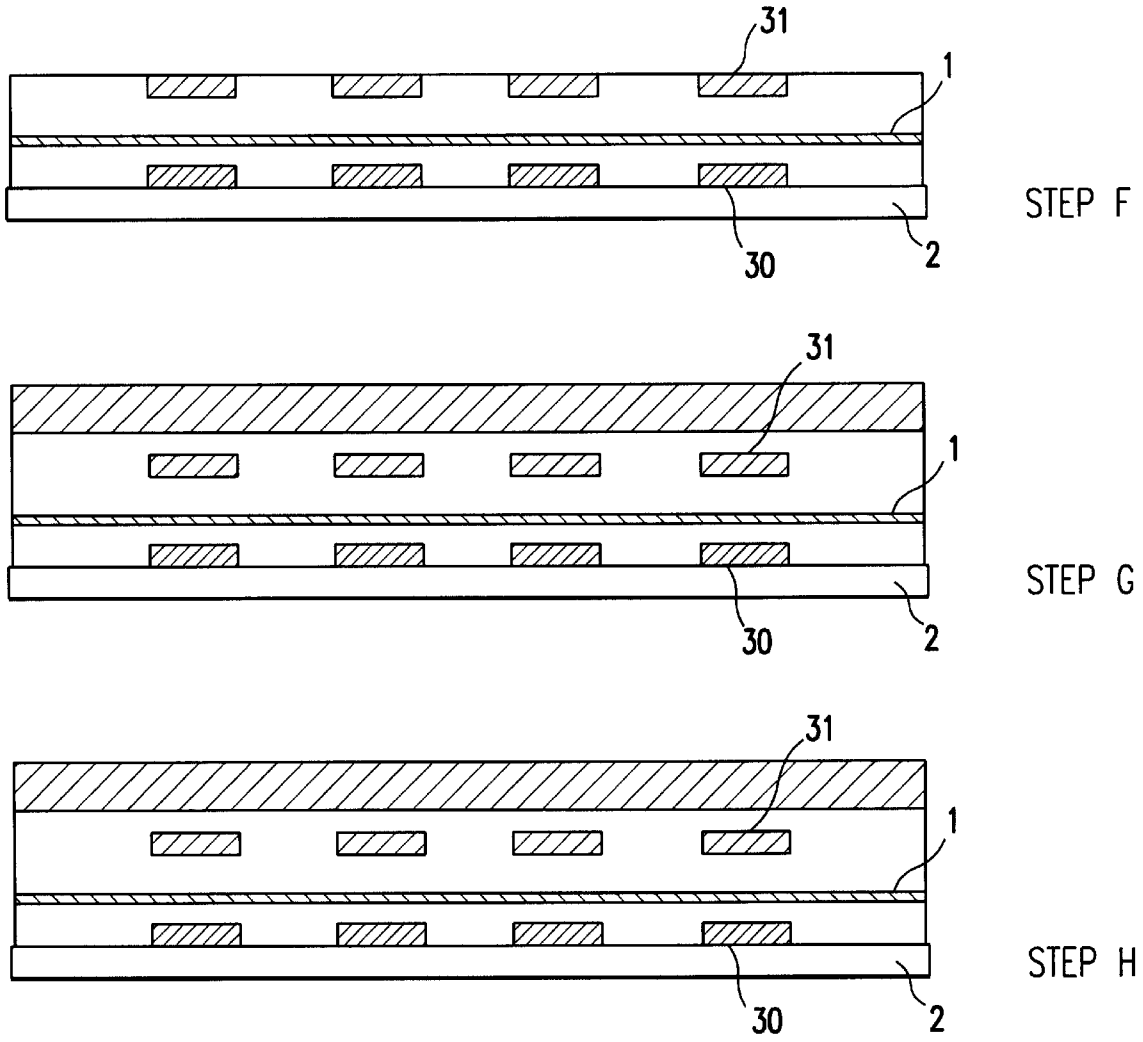
Figures 9A, 9B, 9C, 9D, 9E:
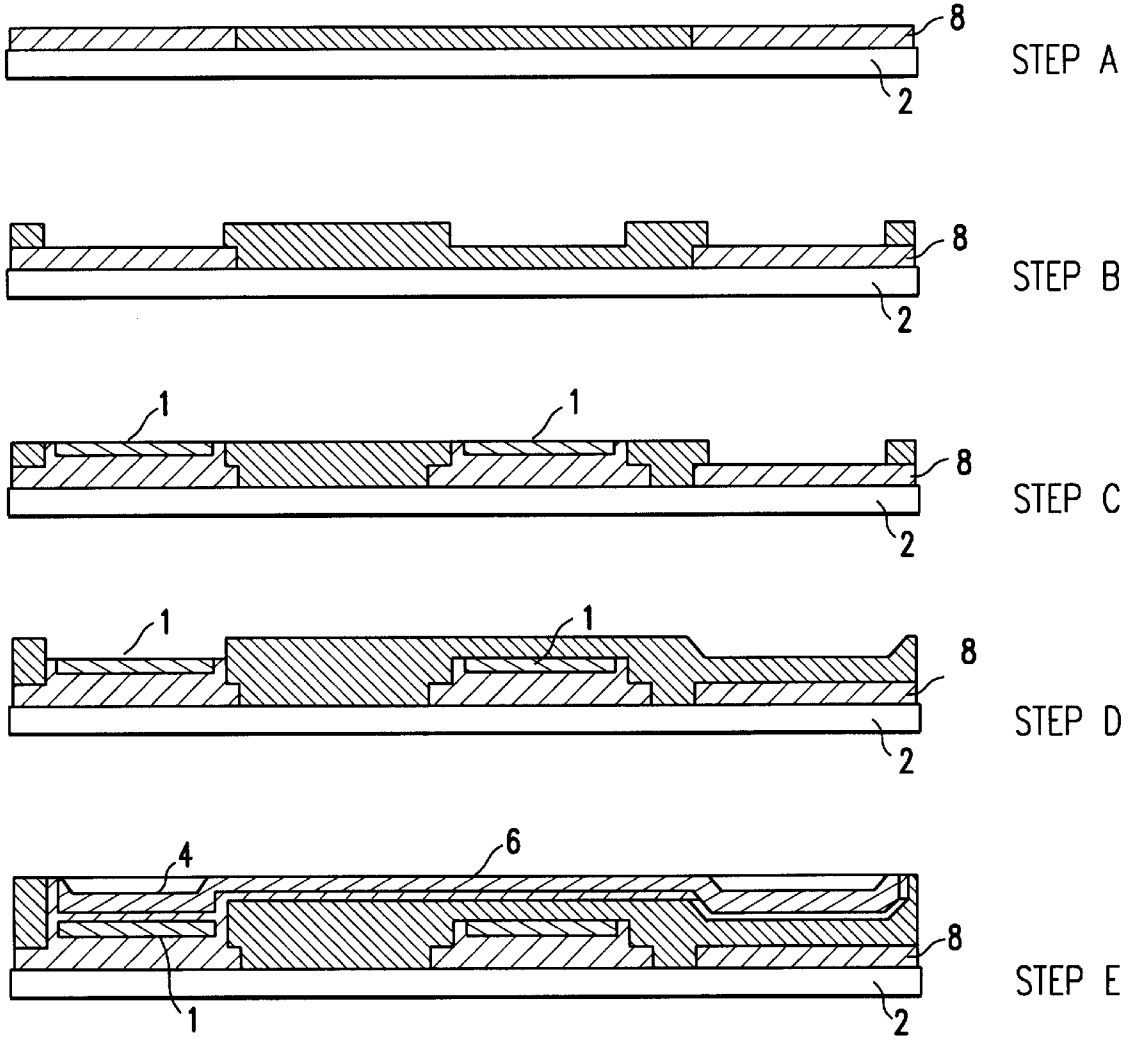
FIG. 9 is a cross-sectional view of the preferred fabrication stages for the embodiment of the present invention shown in FIG. 4A, taken along line 4C—4C of FIG. 4A.
Figure 9F:
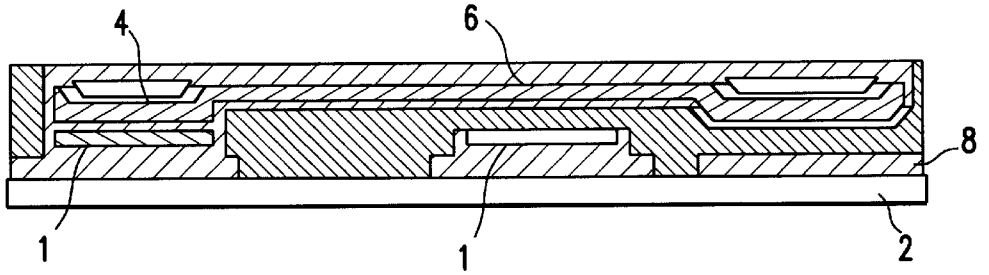
Figure 9G:
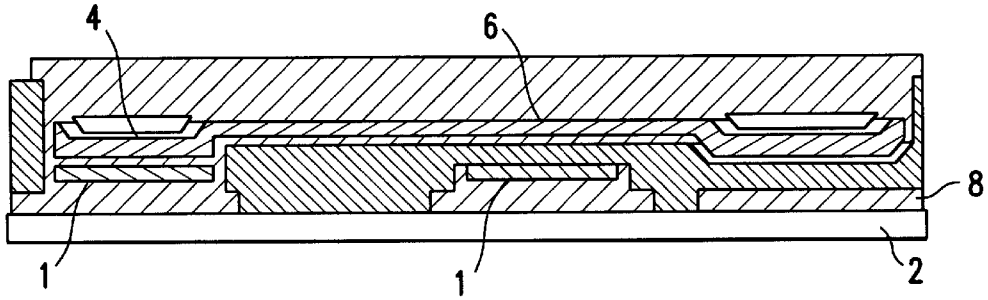
Figure 9H:
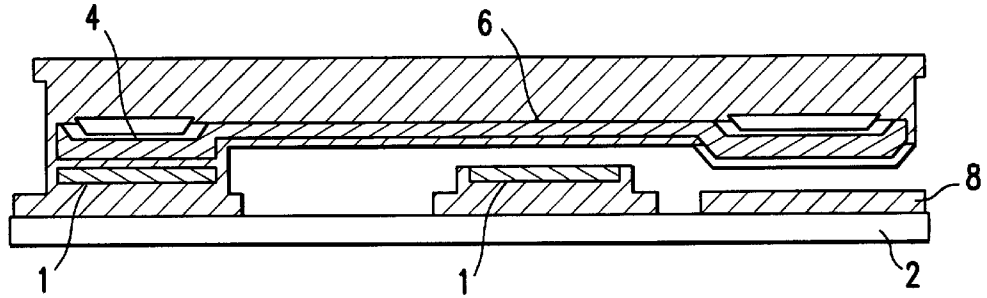

FIGS. 8 and 9 are cross-sectional views of the preferred fabrication stages for the embodiment of the present invention shown in FIG. 4A, taken along lines 4B—4B and 4C–4C, respectively, of FIG. 4A. The following steps describe stages a) through h) of FIGS. 8 and 9:

Step a):

Create permanent planarizing form with Ultra-baked AZ4620.

Produces a thick (>5 μm) planarizing form of permanent, insulating material. Photoresist is used due to its easy patterning, characteristic.

Evaporate Cr/Cu/Cr (of 100 Å/1000 Å/100 Å) electroplating seed layer.

Lays down a plating seed layer which adheres well to the substrate and is compatible with copper plating.

Create a thick (>5 μm) plating mold with soft-bake AZ4620.

Produces an easily removable plating mold. Photoresist is used due to its easy patterning characteristic.

Mold plate copper to height of permanent planarizing form.

Selectively plates material with very high electrical conductance to form the bottom coils 30 of the electromagnetic solenoid.

After plating, remove the photoresist mold.

Soft baked photoresist can be removed with acetone or dedicated photoresist stripper.

Strip the electroplating seed layer, being careful to minimize etching of the plated structures.

The Cr/Cu/Cr seed layer can be etched in a single step with commercial chrome mask etchant which attacks both metals, or in several steps which remove one layer of metal at a time. Cr can be selectively etched with HCl. Cu can be selectively etch ed with a solution of acetic acid, water and hydrogen peroxide.

It should be noted that this step intends to produce an electromagnetic coil with very low resistance and high current carrying capabilities. Many other techniques can be used to accomplish the same goal. These include, but are not limited to, evaporating or sputtering thick metal (e.g., Al, Au, Cu, Ag, etc.) and patterning with wet or dry etching techniques.

Step b):

Create permanent planarizing and insulating layer with Ultra-baked AZ4620. Pattern to create access vias to underlying features.

Produces a thin (<5 μm) planarizing form of permanent, insulating material.

Step c):

Evaporate Cr/Cu/Cr (100 Å/1000 Å/100 Å) electroplating seed layer.

Lays down a plating seed layer which adheres well to the substrate and is compatible with permalloy plating.

Create a thick (>5 μm) plating mold with soft-baked AZ4620.

Mold plate permalloy to height of plating mold.

Selectively plates a material with soft magnetic properties and very high permeability to form the core of the solenoid (the bottom layer 1 of the device's magnetic circuit).

Plating of permalloy is chosen for ease of deposition and resulting excellent magnetic properties. Additional deposition techniques and materials may be used. These include, but are not limited to, sputtering of most any magnetic material or silk screening of magnetic particles suspending in a polyimide matrix.

After plating, remove the photoresist mold.

Strip the electroplating seed layer being careful to minimize etching of the plated structures.

Step d):

Create permanent planarizing and insulating layer with Ultra-baked AZ4620. Pattern to create access vias to underlying features.

Produces a thin (<5 μm) planarizing form of permanent, insulating material.

Step e):

Evaporate Cr/Cu/Cr (100 Å/1000 Å/100 Å) electroplating seed layer.

Lays down a plating seed layer which adheres well to the substrate and is compatible with permalloy plating.

Create a thick (>5 μm) plating mold with soft-bake AZ4620.

Mold plate permalloy to height of plating mold.

Selectively plates a material with soft magnetic properties and very high permeability to form the top layer 4 of the device's magnetic circuit. This plating also forms a cantilever beam 6 which will ultimately become free standing.

After plating, remove the photoresist mold.

Strip the electroplating seed layer, being careful to minimize etching of the plated structures.

Step f):

Evaporate Cr/Cu/Cr (100 Å/1000 Å/100 Å) electroplating seed layer.

Create a thick (>5 μm) plating mold with soft-bake AZ4620.

Mold plate copper to height of plating mold.

Selectively plates material with very high electrical conductance to form the top coils 31 of the electromagnetic solenoid.

After plating, remove the photoresist mold.

Strip the electroplating seed layer, being careful to minimize etching of the plated structures.

Step g):

Evaporate Cr/Cu/Cr (100 Å/1000 Å/100 Å) electroplating seed layer.

Create a thick (>5 μm) plating mold with soft-bake AZ4620.

Mold plate copper to height of plating mold.

Selectively plates material with very high electrical conductance to decrease the resistance of the cantilever beam 6. This is optional. This plating also creates a plasma ashing shield which could be created in other ways such as an evaporated chrome layer.

After plating, remove the photoresist mold.

Strip the electroplating seed layer, being careful to minimize etching of the plated structures.

Step h):

Strip sacrificial photoresist with isotropic plasma.

Strips sacrificial material from beneath the top magnetic cantilever beam 6 to produce a free standing structure without damaging the other materials in the device. Isotropic plasma is the preferred choice but well controlled wet etching with acetone or photoresist stripper could be used.

B. Second Process

Figures 10A, 10B, 10C, 10D, 10E, 10F:
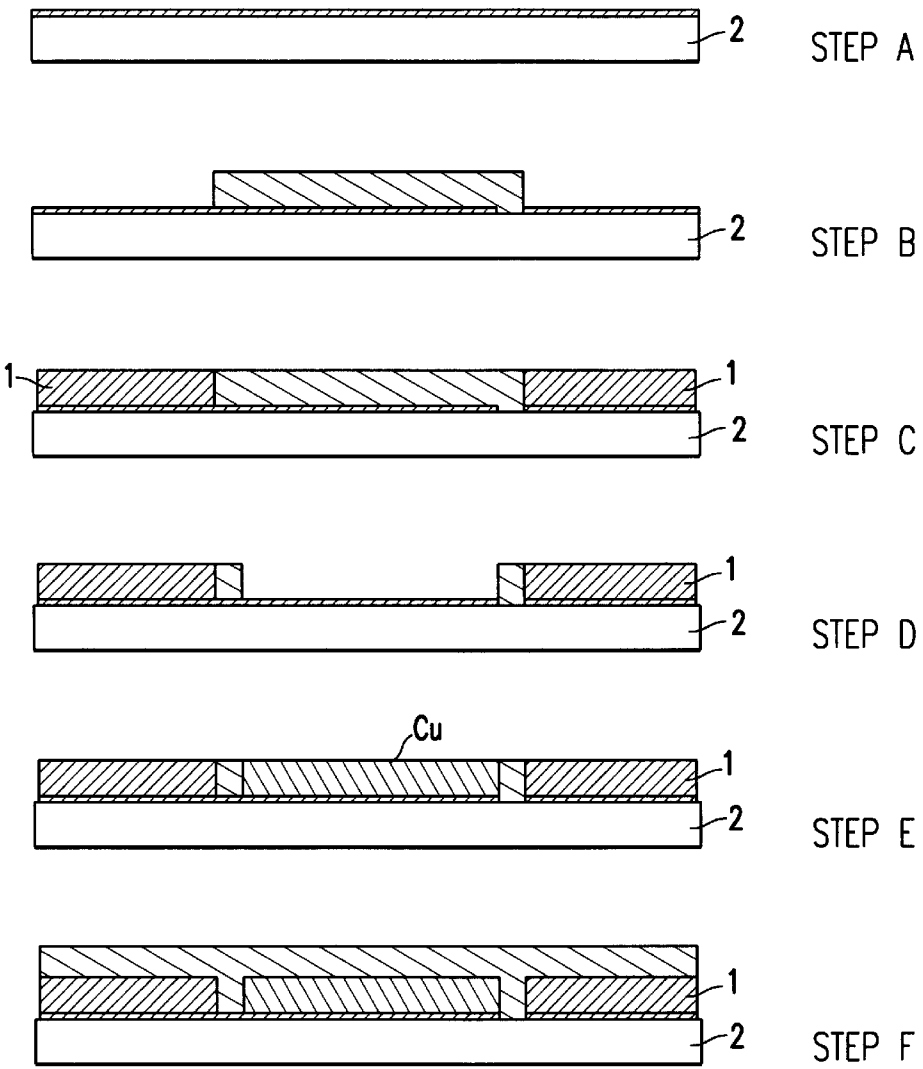
FIGS. 10A and 10Q are cross-sectional side views of the preferred fabrication stages for the coil structure of a three-coil embodiment of the present invention.
Figure 10G:
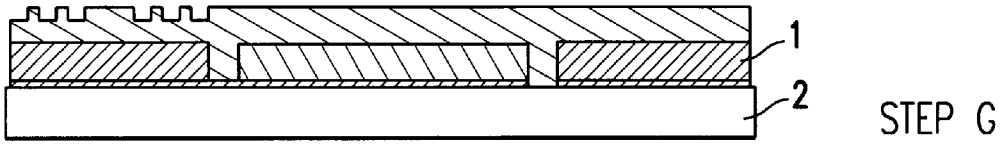
Figure 10H:
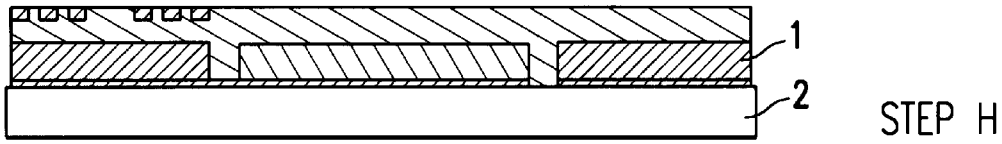
Figure 10I:
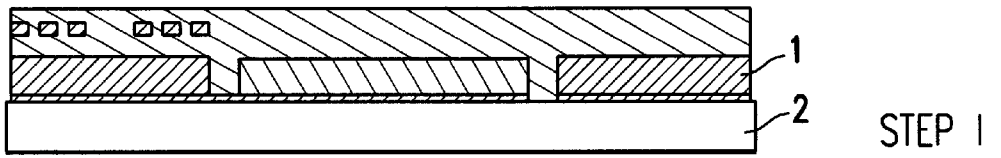
Figure 10J:
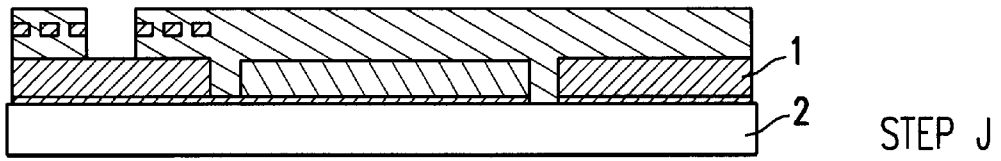
Figures 10K, 10L, 10M, 10N:
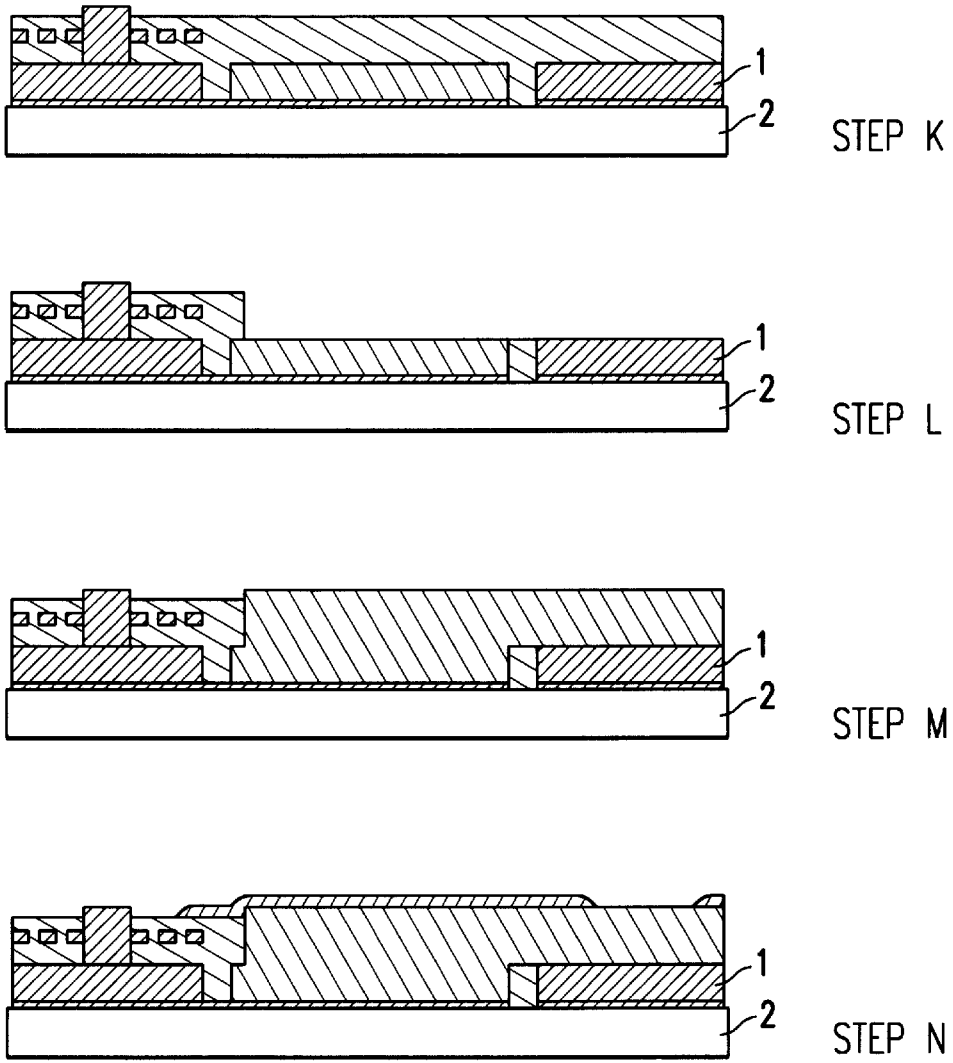
Figure 10O:
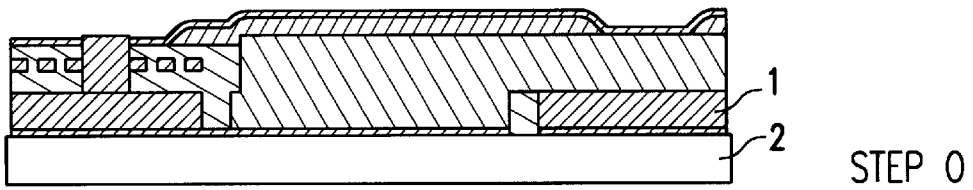
Figure 10P:
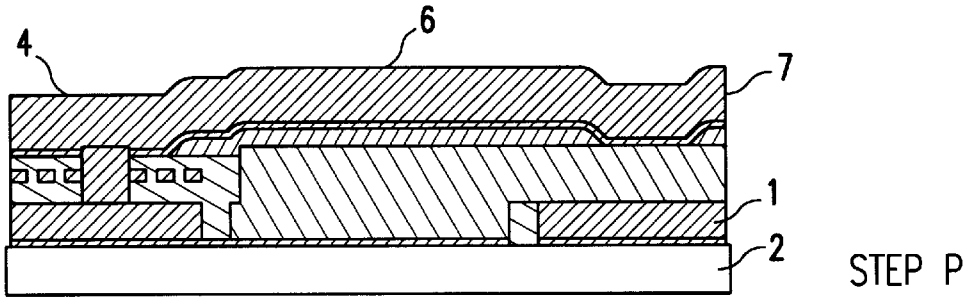
Figure 10Q:
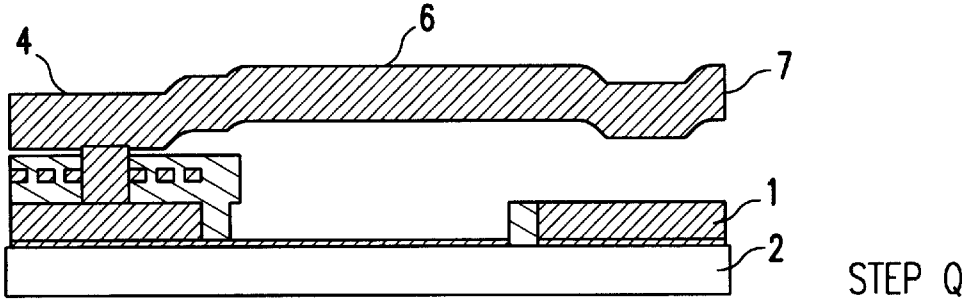
Figures 11A, 11B, 11C, 11D, 11E, 11F:
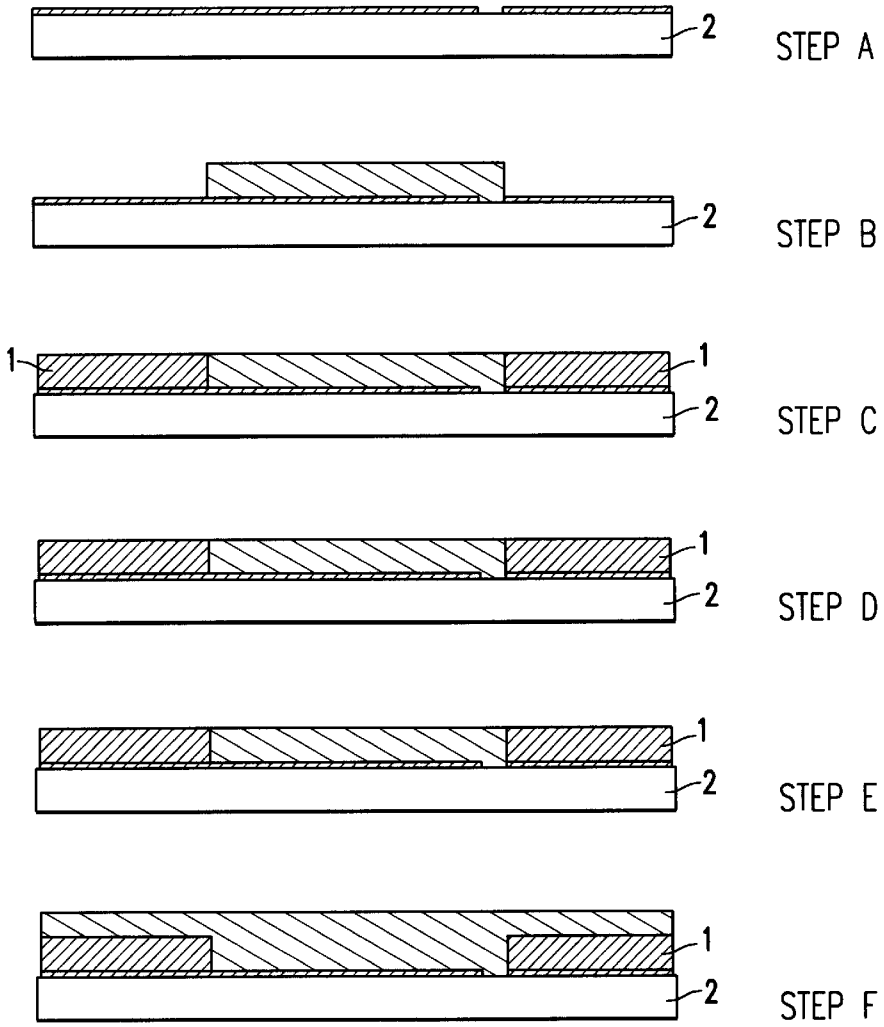
FIGS. 11A and 11Q are cross-sectional side views of the preferred fabrication stages for the cantilever beam of a three-coil embodiment of the present invention.
Figure 11G:
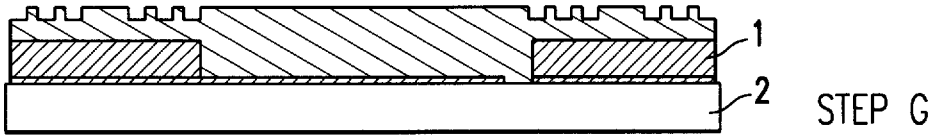
Figure 11H:
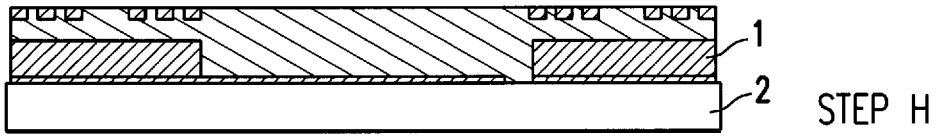
Figure 11I:
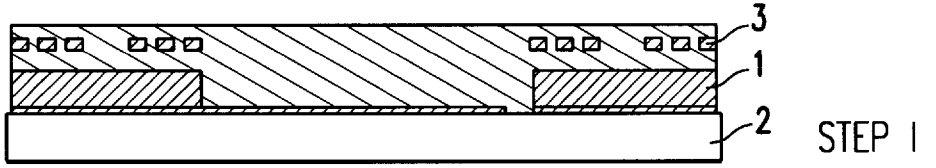
Figure 11J:
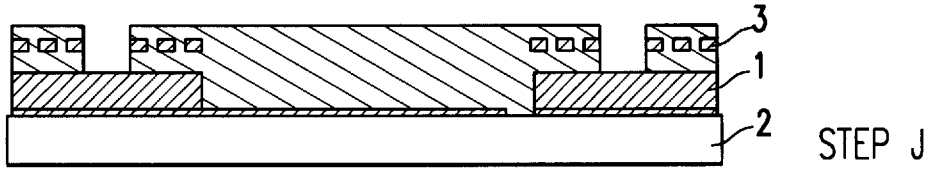
Figure 11K:
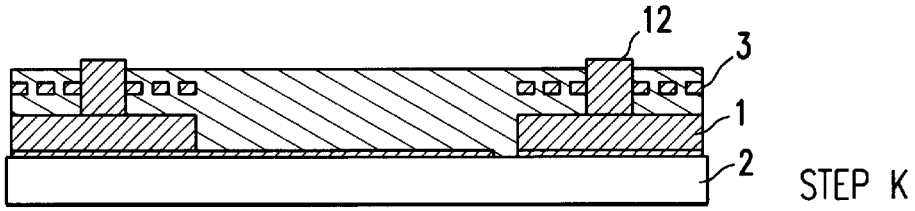
Figure 11L:
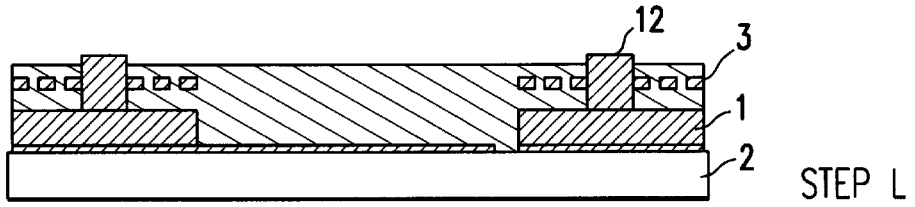
Figure 11M:
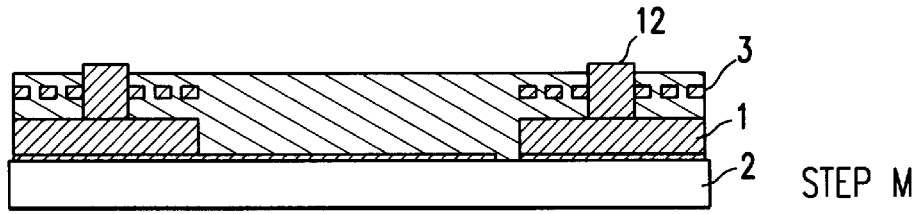
Figure 11N:
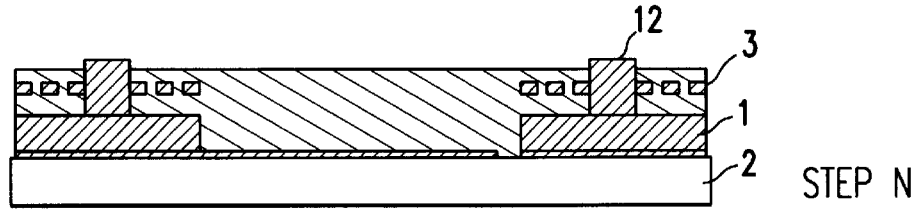
Figure 11O:
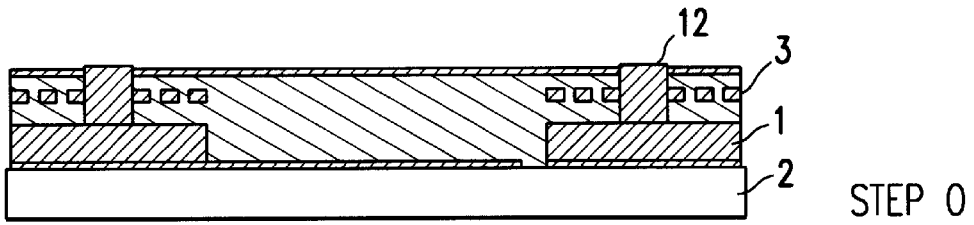
Figure 11P:
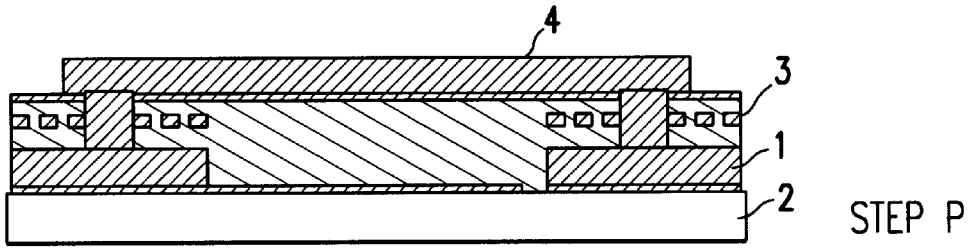
Figure 11Q:
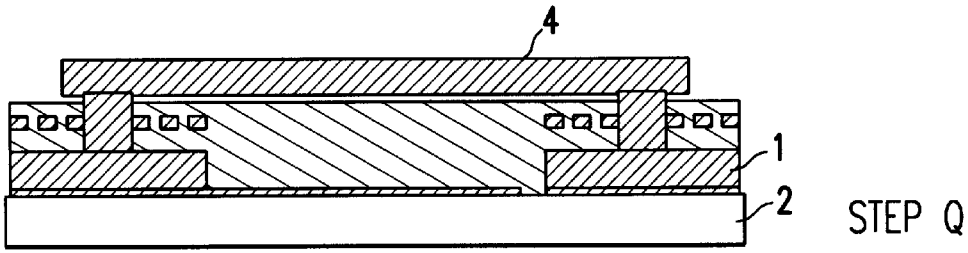

FIGS. 10A and 10Q are cross-sectional views of the preferred fabrication stages for a three coil embodiment of the present invention, similar to FIG. 12A described below, taken along the cantilever beam 6. FIGS. 11A and 11Q are cross-sectional views of the preferred fabrication stages for the embodiment of FIG. 10A, taken along the magnetic circuit. The following steps describe stages a) through qg of these sets of figures:

Step a): Grow oxide layer on substrate 2 of about 5000 Å for insulation. Deposit plating seed layer—preferably Cr/Ni but for now Cr/Cu→100 Å to 1000 Å.

Step b): Pattern seed layer and remove from areas that may be problematic (i.e., where contact would be shorted if seed layer left). Note: The dicing of the dies can also be used in design to end up with electrically isolated contacts. Make sure to have highly conductive paths from areas to be plated on the die frame. Spin and pattern (using Cr mask) thick polyimide (≈100 μm) and hard bake.

Step c): Plate thick permalloy to height just below height of polyimide (PI) to form first layer 1. If cannot get 100 μm (or the desired thickness of PI) in one iteration, repeat b) and c) as many times as necessary.

Step d): Etch PI from area which will be spanned by the cantilever beam. Preferably use Cr RIE mask. Can overetch because have metal seedlayer beneath area being etched.

Step e): Plate up through areas opened in d) with Cu, using seedlayer left behind from the plating of the first permalloy layer 1. Note: plate to level just below height of PI.

Step f): Strip Cr RIE mask. Coat with layer of PI≈3 μm.

Step g): Pattern PI layer to form molds for coils.

Step h): Create planar coils 3 using deposited metal, preferably either electroplated Cu or evaporated Al (in the example shown, multiple coils are formed).

Step i): Coat with PI (and pattern vias if doing another layer of coils). If another layer of coils is desired, repeat steps g) and h).

Step j): Etch PI from center of coils 3 where magnetic core 12 will be, preferably using a Cr RIE mask. Can overetch because have permalloy beneath area being etched.

Step k): Plate up through areas opened in step j) with permalloy using seedlayer left behind from the plating of the first permalloy layer. Note: can overplate with negligible problems.

Step l): Etch PI from area that will be spanned by the cantilever beam (see FIG. 10L), preferably using a Cr RIE mask. Can overetch because areas being etched have metal seed layer or permalloy beneath them.

Step m): Plate-up Cu to just above the PI height.

Step n): Spin and pattern AZ4620 PR to produce dimple in cantilever beam (this dimple is not really necessary). Note: evaporating Cu in the next step may make it impossible to remove this layer with developer after beam has been plated. If PR becomes hard baked, it may require PR stripper to remove it. If the selected PR stripper attacks 180° C. baked PI, then may need to use plated Cu in this step.

Step o): Evaporate Cr/Cu seed layer. Pattern to remove seed layer from core areas so second layer 4 of permalloy will plate from the core metal and not the Cu. (Preferably pattern Cr/Cu so access to permalloy core is slightly smaller than permalloy core itself.) Spin and pattern (using Cr mask) thick polyimide (≈100 μm) and hard bake.

Step p): Plate thick permalloy second layer 4 to height just below the height of the PI. If cannot get 100 μm (or the desired thickness of PI) in one iteration, repeat steps o) and p) as many times as necessary. Note: since the second layer 4 of permalloy is so thick, it may be more practical to create a thin (≈2 μm) plating mold. Since the dimensions of the circuit are so large and this is the last layer, the mushrooming that will occur while plating 100 μm in a 2 μm mold is not a big concern as long as the mask is designed with this in mind. This makes the creation of the mold much easier and if AZ4620 resist is used, developer can be used to strip it.

Step q): Plasma ash to remove second layer permalloy PI mold, and free structures with Cu etchant, thereby freeing the cantilever beam 6 (which is supported by electroplated Cu) and removing the seed layer for the second layer 4.

C. Third Process

Figure 12A:
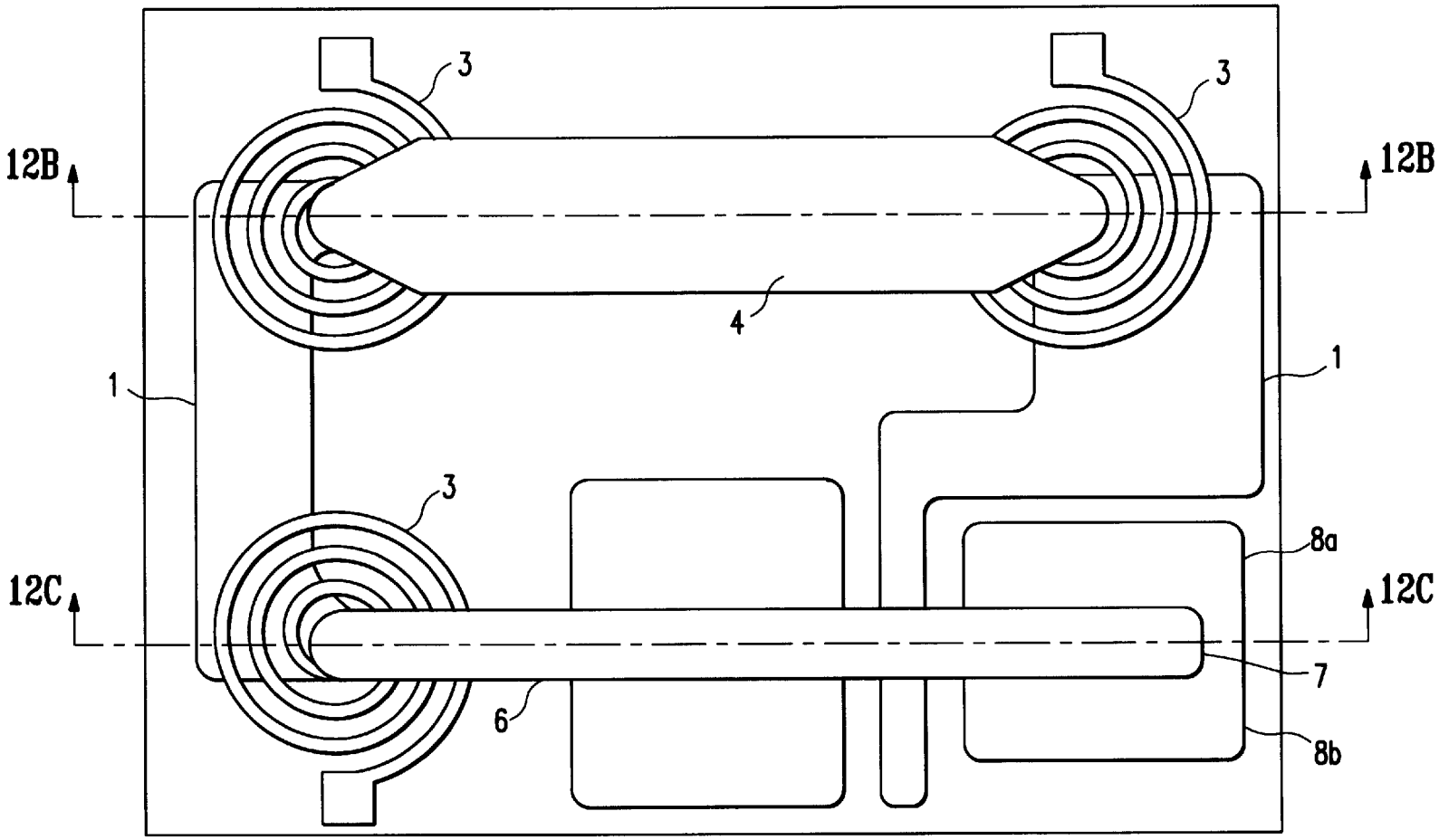
FIG. 12A is top view of an alternative embodiment of the present invention showing three coils.
Figure 12B:
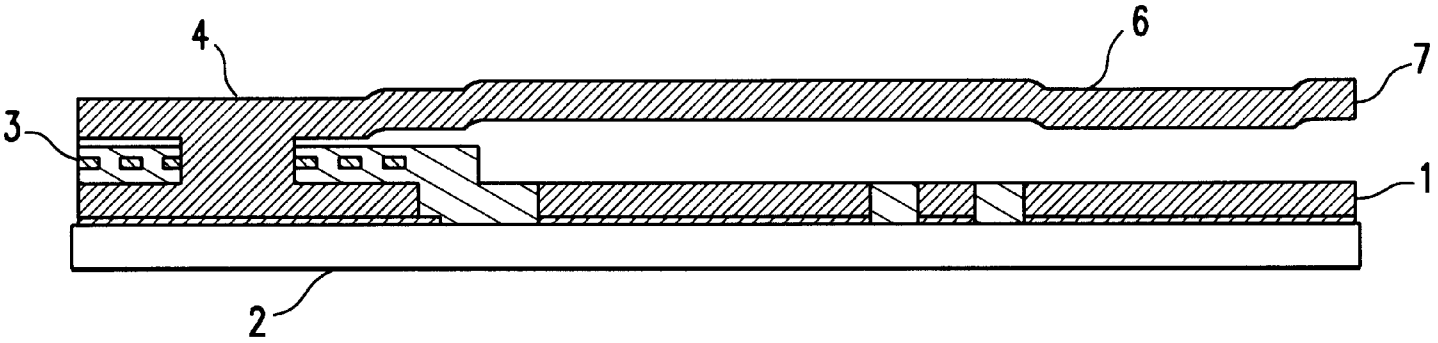
FIG. 12B is a cross-sectional view of the structure in FIG. 12A, taken along line 12B—12B of FIG. 12A.
Figure 12C:
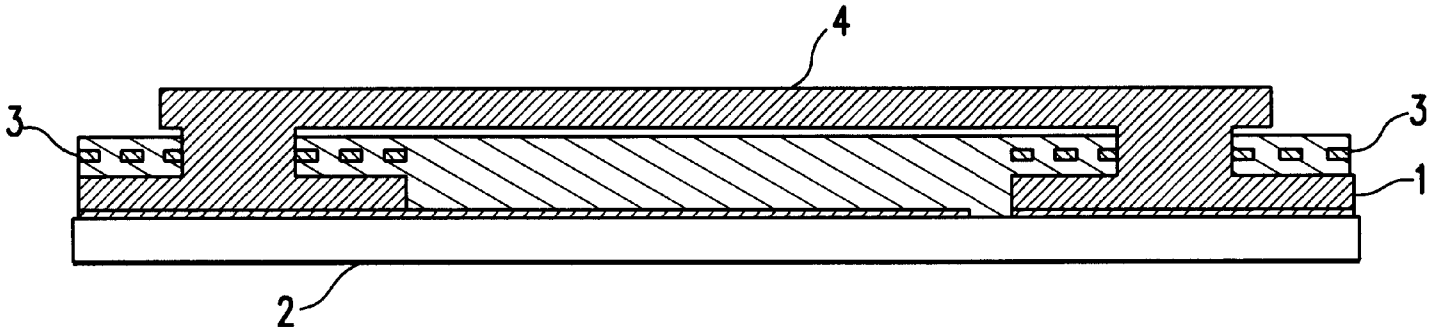
FIG. 12C is a cross-sectional view of the structure in FIG. 12A, taken along line 12C—12C of FIG. 12A.
Figures 13A, 13B, 13C, 13D, 13E:
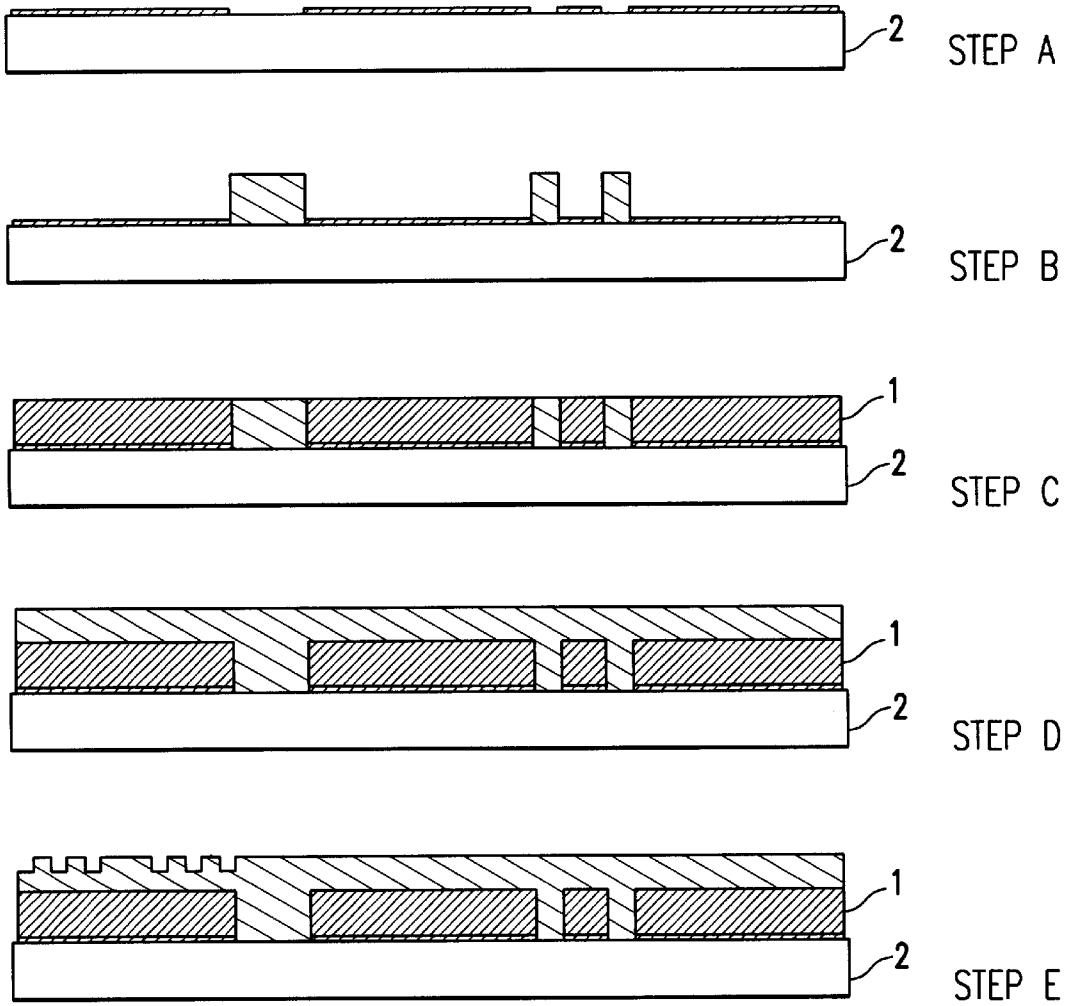
FIG. 13 is a cross-sectional view of the preferred fabrication stages for the embodiment of the present invention shown in FIG. 1 2A, taken along line 12B—12B of FIG. 12A.
Figures 13F, 13G, 13H, 13I, 13J:
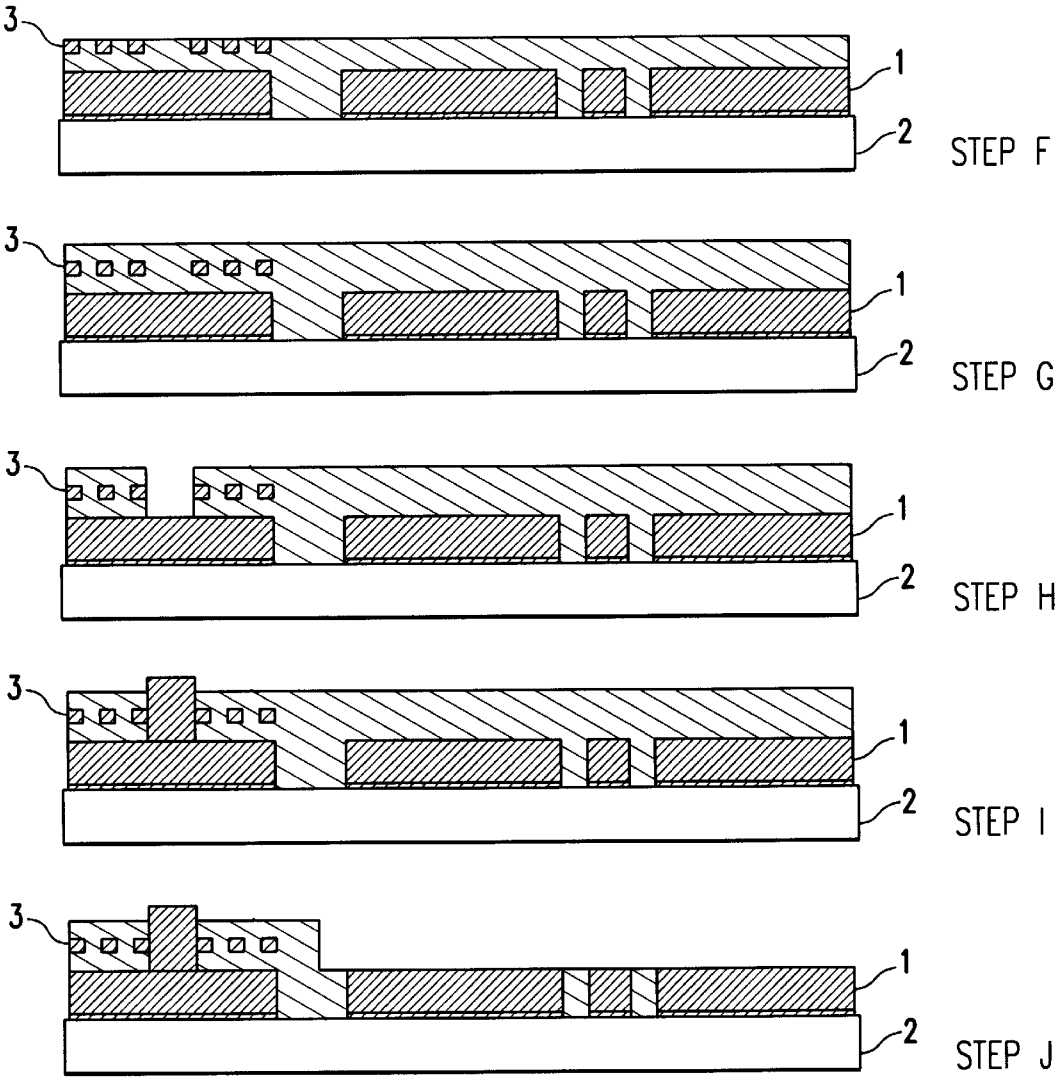
Figure 13K:
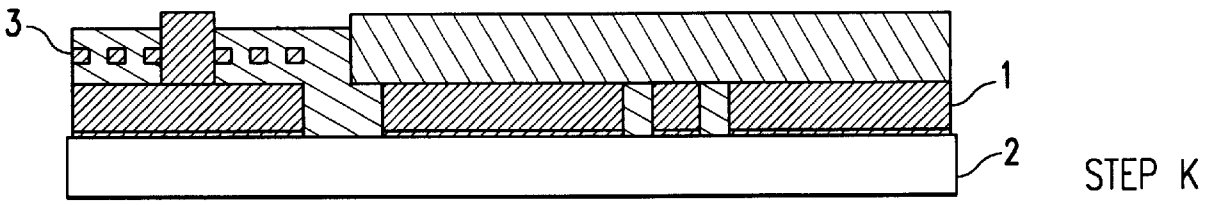
Figure 13L:
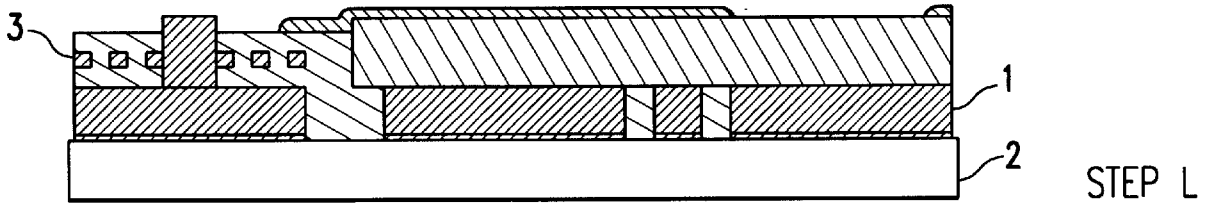
Figure 13M:
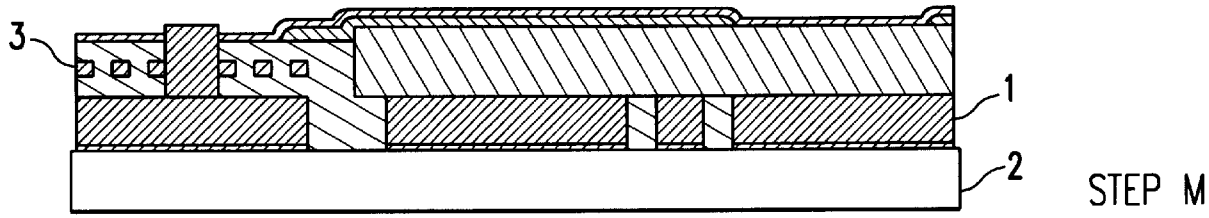
Figure 13N:
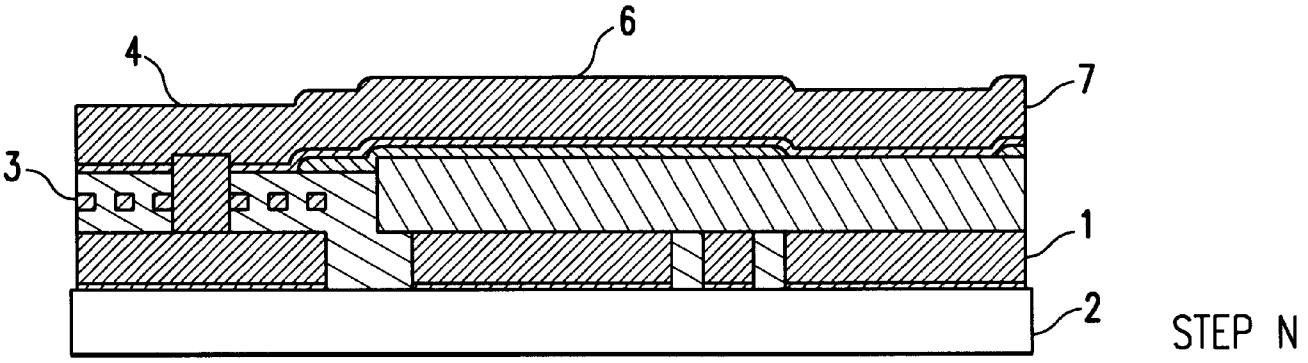
Figure 13O:
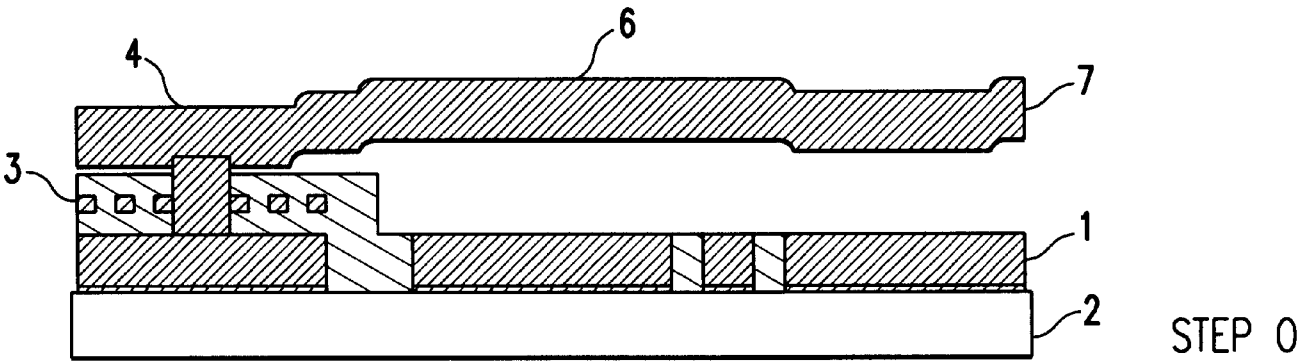
Figures 14A, 14B, 14C, 14D, 14E:
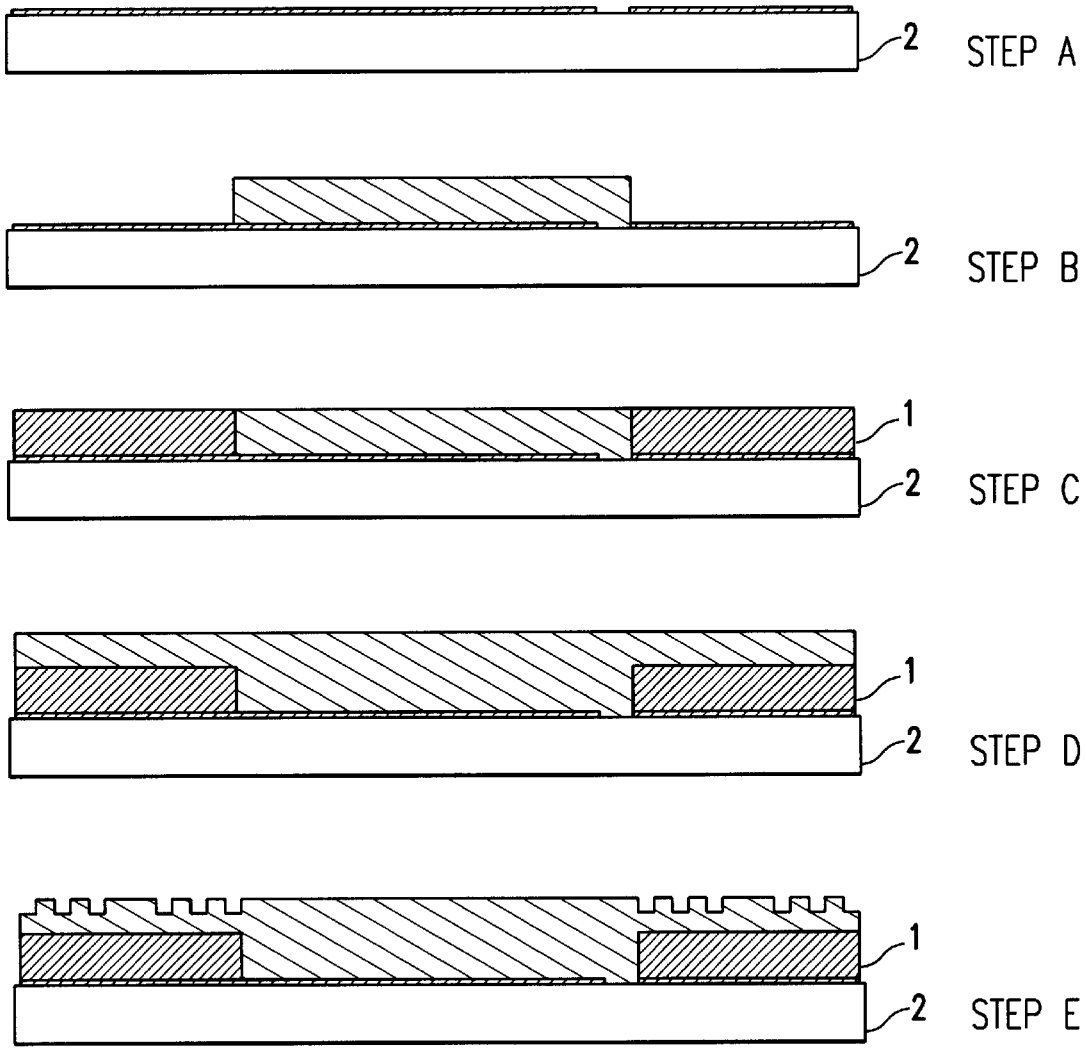
FIG. 14A–14O are a cross-sectional view of the preferred fabrication stages for the embodiment of the present invention shown in FIG. 12A, taken along line 12C—12C of FIG. 12A.
Figures 14F, 14G, 14H, 14I, 14J:
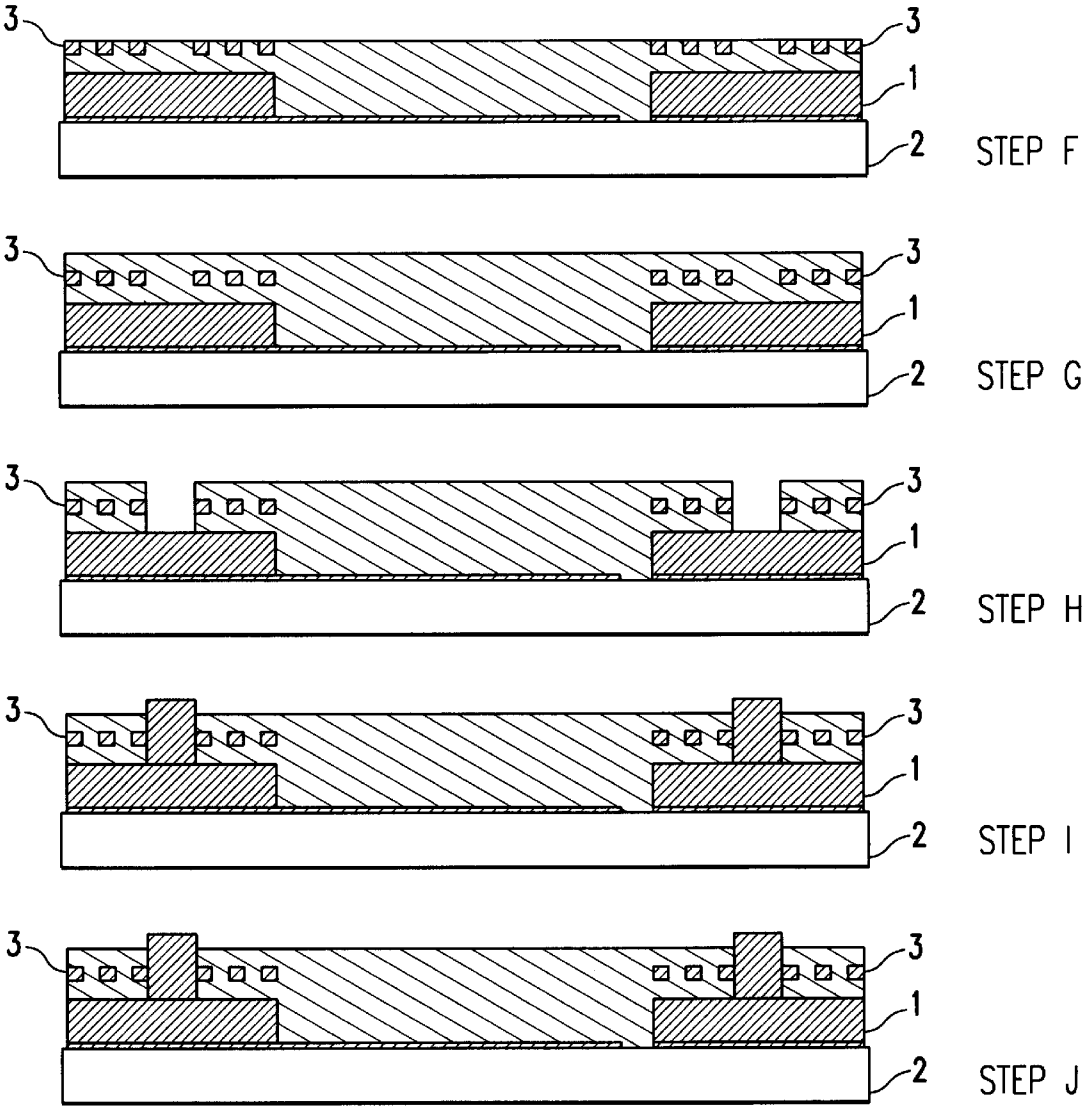
Figure 14K:
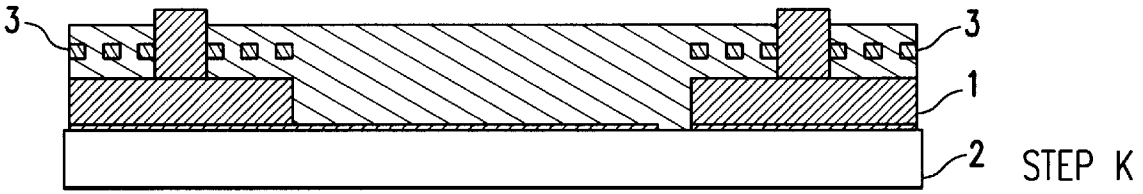
Figure 14L:
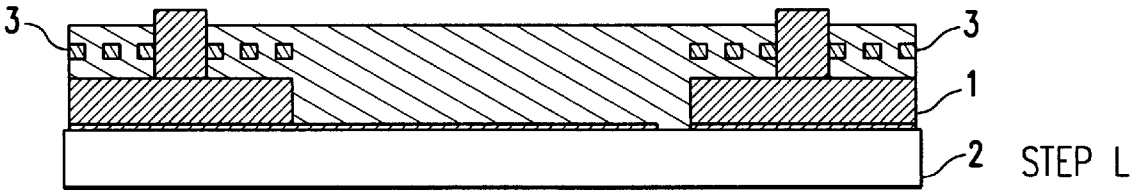
Figure 14M:
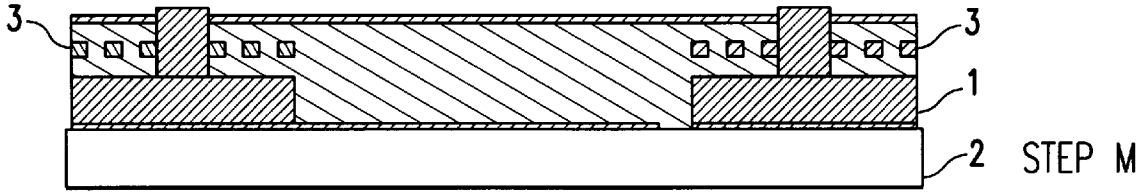
Figure 14N:
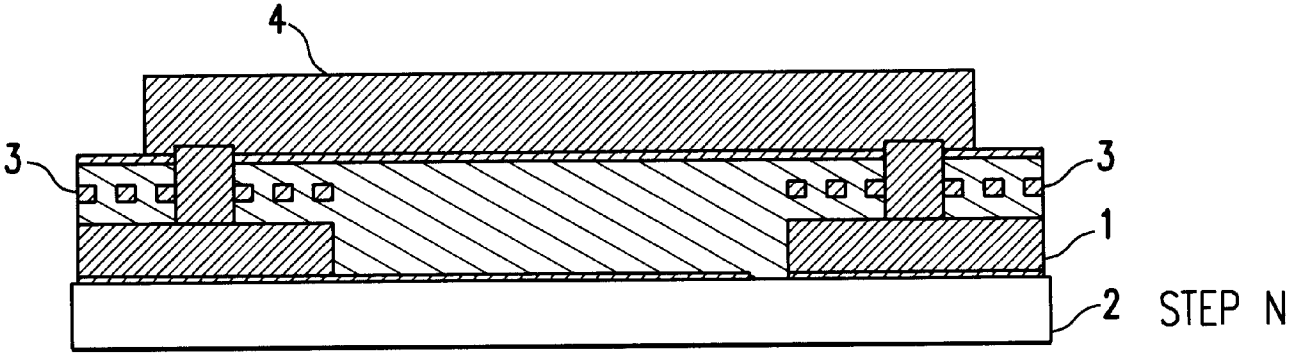
Figure 140:
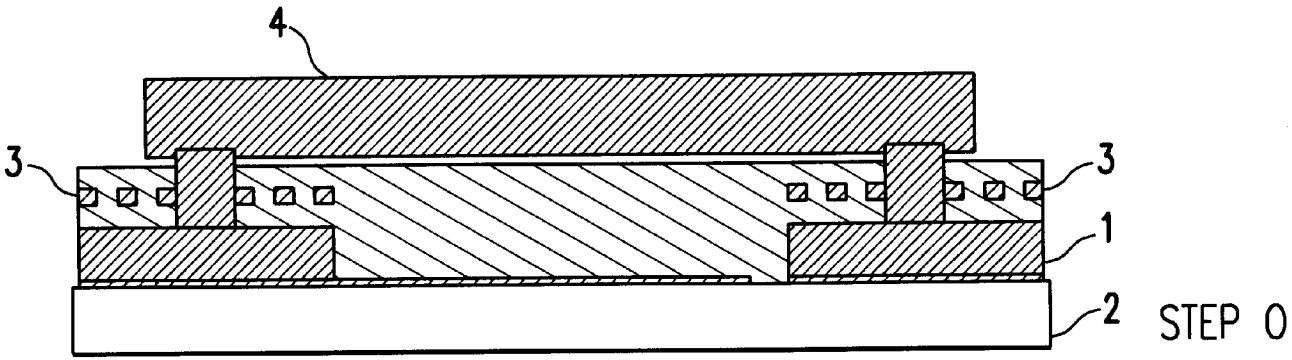

FIG. 12A is top view of an alternative embodiment of the present invention showing three coils 3 rather than one. FIGS. 12B and 12C are cross-sectional views of the structure in FIG. 12A. All structures are formed on one side of the substrate 2.

FIGS. 13 and 14 are cross-sectional views of the preferred fabrication stages for the embodiment of FIG. 12A, taken along lines 12B—12B and 12C—12C, respectively. The following steps describe stages a) through o) of these sets of figures:

Step a):

Start with silicon substrate coated with insulator. Evaporate Cr/Cu/Cr (100 Å/1000 Å/100 Å) electroplating seed layer.

Choose silicon for convenience and for the potential to integrate electronic circuitry into the switch. In general, almost any material can be used for the substrate as long as it is compatible with the following processes. Possible examples are printed circuit boards, glass, ceramics, plastics, etc.

Insulation is required so the subsequently deposited electromagnetic coils 3 will not be short circuited. While almost any insulating material can be used, nitride or oxide is most suitable for the silicon substrate.

Lay down a plating seed layer which adheres well to the substrate and is compatible with permalloy plating. Preferably, Cr/Ni is used. Examples of other possible seed layers are Cr; Al/Cu and Ti/Cu.

Step b):

Pattern seed layer so that plating in all areas is still possible but such that removal of the seed layer after plating is not necessary. On top of this layer, create a mold with polyimide.

Patterning of the seedlayer is done so that it will not need to be stripped after the first permalloy plating. Dicing will be used to electrically isolate those structures that cannot be shorted together. This step is intended to enhance the process but the traditional stripping of the mold material and seed layer can also be done if preferred. An additional step to planarize the surface would probably be needed if this was done.

Produce a thick (>10 μm) permanent plating mold. Polyimide is used due to its easy patterning characteristics, easy deposition and compatibility with subsequent steps.

Step c):

Mold plate permalloy to height just below height of polyimide to form first magnetic layer.

Selectively plate a material with soft magnetic properties and very high permeability to form the bottom layer of the device's magnetic circuit.

Plating of permalloy is chosen for ease of deposition and resulting excellent magnetic properties. Additional deposition techniques and materials may be used. These include, but are not limited to, sputtering of most any magnetic material or silk screening of magnetic particles suspending in a polyimide matrix.

Step d):

Insulate the permalloy structures with a thin (<5 μm) coat of patterned polyimide.

The permalloy structure would be shorted by subsequent metal layer depositions if they were not covered by an insulating layer. Polyimide is chosen for its ease of deposition, ease of patterning and its mechanical properties. Other insulators, such photoresist or oxide, could be used.

The insulating layer needs to be patterned to allow access to bond pads and contact points.

Step e):

Create a permanent pseudo-mold with polyimide.

Lay down another thick (>5 μm) layer polyimide to form a permanent pseudo-mold for a subsequent copper plating. This is a pseudo-mold because, while it is filled by a subsequent copper plating, it does not directly control that copper plating. This step is included to improve planarization.

Step f):

Create a mold with soft-bake AZ4620. Mold plate copper to height of polyimide layer in step e). After plating, remove the photoresist mold. Strip the electroplating seed layer, being careful to minimize etching of the plated structures.

Produce an easily removable plating mold. Photoresist is used due to its easy patterning characteristic.

Selectively plate material with very high electrical conductance to form the electromagnetic coil. It should be noted that this tends to produce an electromagnetic coil with very low resistance and high current carrying capabilities. Many other techniques can be used to accomplish the same goal. These include, but are not limited to, evaporating or sputtering thick metal (for example, Al, Au, Cu, Ag, etc.) and patterning with wet or dry etching techniques.

Soft baked photoresist can be removed with acetone or dedicated photoresist stripper. The stripper used should not damage the underlying polyimide layers.

The Cr/Cu/Cr seed layer can be etched in a single step with commercial chrome mask etchant which attacks both metals or in several steps which remove one layer of metal at a time. Cr can be selectively etched with HCl. Cu can be selectively etched with a solution of acetic acid, water and hydrogen peroxide.

It should be noted that more than one layer of planar coils can be produced on top of one another. To do this, steps d) through f) need to be repeated.

Step g):

Insulate the permalloy structures with a thin (<5 μm) coat of patterned polyimide.

Other insulators, such photoresist or oxide, could be used. The insulating layer needs to be patterned to allow access to bond pads and contact points.

Step h):

Etch PI from center of coils where magnetic core will be.

It is desirable, but not necessarily required, to have a permalloy core plated up through the electromagnetic coil, connecting the top and bottom magnetic layers.

RIE plasma can be used to etch the polyimide. A thin Cr masking layer can be use to protect the areas of the device that are not to be etched. Overetching in this step should not be a problem as there should be permalloy beneath the polyimide in the areas being etched.

Step i):

Plate up through areas opened in step h) with permalloy using the seedlayer left behind from the plating of the first permalloy layer.

It is desirable, but not necessarily required, to have a permalloy core plated up through the electromagnetic coil, connecting the top and bottom magnetic layers. If this core is not created, step h) is not necessary.

Step j):

Etch PI from area which will be spanned by cantilever beam.

RIE plasma can be used to etch the polyimide. A thin Cr masking layer can be use to protect the areas of the device that are not to be etched.

Step k):

Plate copper up to the height of the top polyimide.

This copper will be used as a sacrificial layer. Many other sacrificial materials, such as aluminum, photoresist, or oxide could be used. A seed layer for this may need to be deposited prior to plating or, with special attention in previous steps, the seed layer used to plate the first permalloy could be used.

Step l):

Spin and pattern AZ4620 to produce optional dimple in cantilever beam.

Produce an easily removable plating sub-mold which will create contact dimples in the subsequently plated moving contact at the end of the cantilever beam. This is an optional step as the dimple may not be needed. Photoresist is used because it can be easily patterned and easily removed.

Step m):

Evaporate Cr/Cu/Cr (100 Å/1000 Å/100 Å) electroplating seed layer and pattern.

Lay down a plating seed layer which adheres well to the substrate and is compatible with permalloy plating. Preferably, Cr/Ni would be used. Examples of other possible seed layers are Cr, Al/Cu and Ti/Cu.

This layer can be patterned for two effects. First, it can be patterned over the permalloy cores plated in step i) to allow direct contact between the permalloy cores and the top permalloy layer. Second, it can be patterned in such a way as to eliminate the need to remove the seed layer after the top permalloy is plated. As with the seed layer used to plate the first permalloy layer, dicing can be used to isolate the plated structures.

Step n):

Create a mold with soft-bake AZ4620. Mold plate a thick (>5 μm) layer of permalloy. After plating, remove the photoresist mold. Strip the electroplating seed layer if necessary.

Produce an easily removable plating mold. Photoresist is used due to its easy patterning characteristic.

Selectively plate a material with soft magnetic properties and very high permeability to form the top layer 4 of the device's magnetic circuit. This plating also forms a cantilever beam 6 which will ultimately become free standing.

Plating of permalloy is chosen for ease of deposition and resulting excellent magnetic properties. Additional deposition techniques and materials may be used. These include, but are not limited to, sputtering of most any magnetic material or silk screening of magnetic particles suspending in a polyimide matrix.

Step o):

Strip sacrificial copper.

Strip sacrificial material from beneath the top magnetic cantilever beam 6 to produce a free standing structure without damaging the other materials in the device. A copper etchant such as a mixture of acetic acid, water and hydrogen can be used as well as other etchants which will not attack the magnetic material.

D. Fourth Process

Figure 15A:
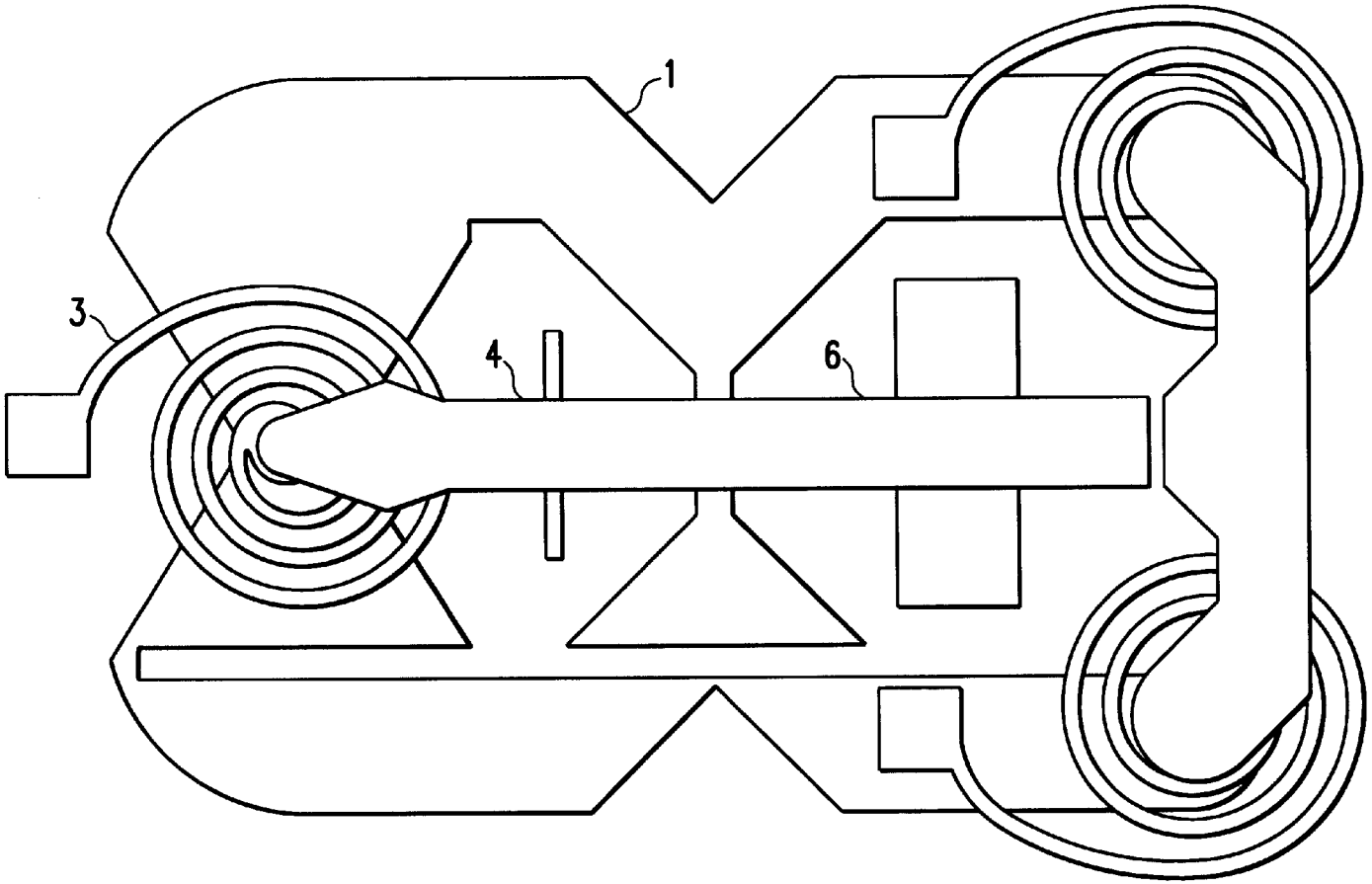
FIG. 15A is top view of an alternative embodiment of the present invention, showing a recessed fabrication switch design.
Figure 15B:
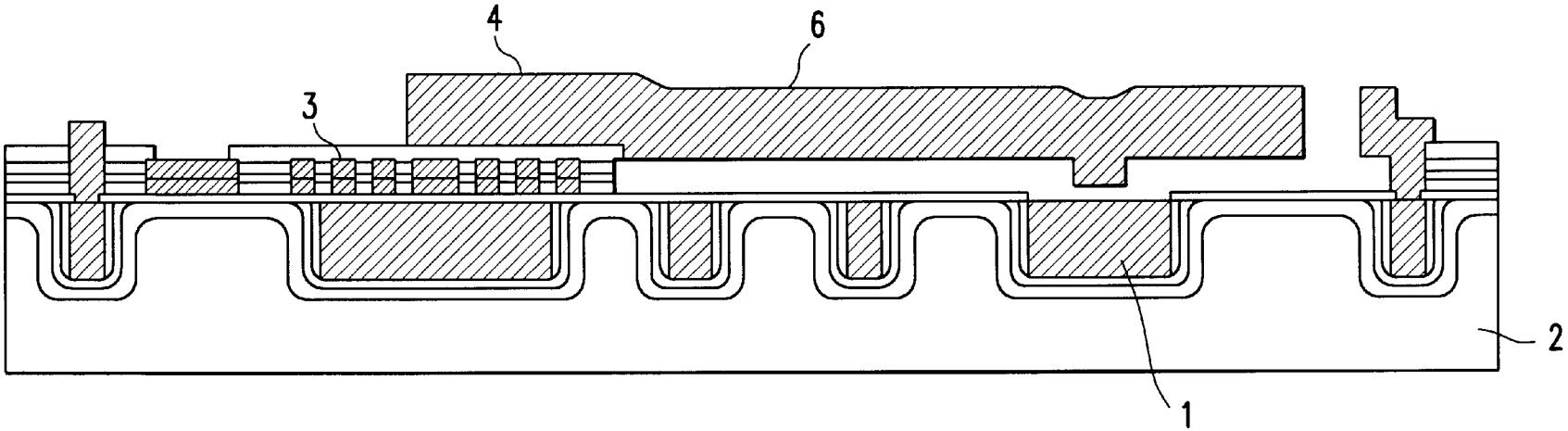
FIG. 15B is a cross-sectional view of the structure in FIG. 15A, taken along the cantilever beam in FIG. 15A.

FIG. 15A is top view of an alternative embodiment of the present invention, showing three coils 3 rather than one. FIG. 15B is a cross-sectional view of the structure in FIG. 15A, taken along the cantilever beam 6. All structures are formed on one side of the substrate 2. In contrast to the embodiment shown in FIG. 12A, where all structures are formed on top of the substrate 2, the embodiment shown in FIG. 15A creates structures in part by etching recesses into the substrate. Hence, as used herein, the term "on the substrate" includes formation on the original surface of a substrate and formation within the substrate.

Figures 16A, 16B, 16C, 16D:
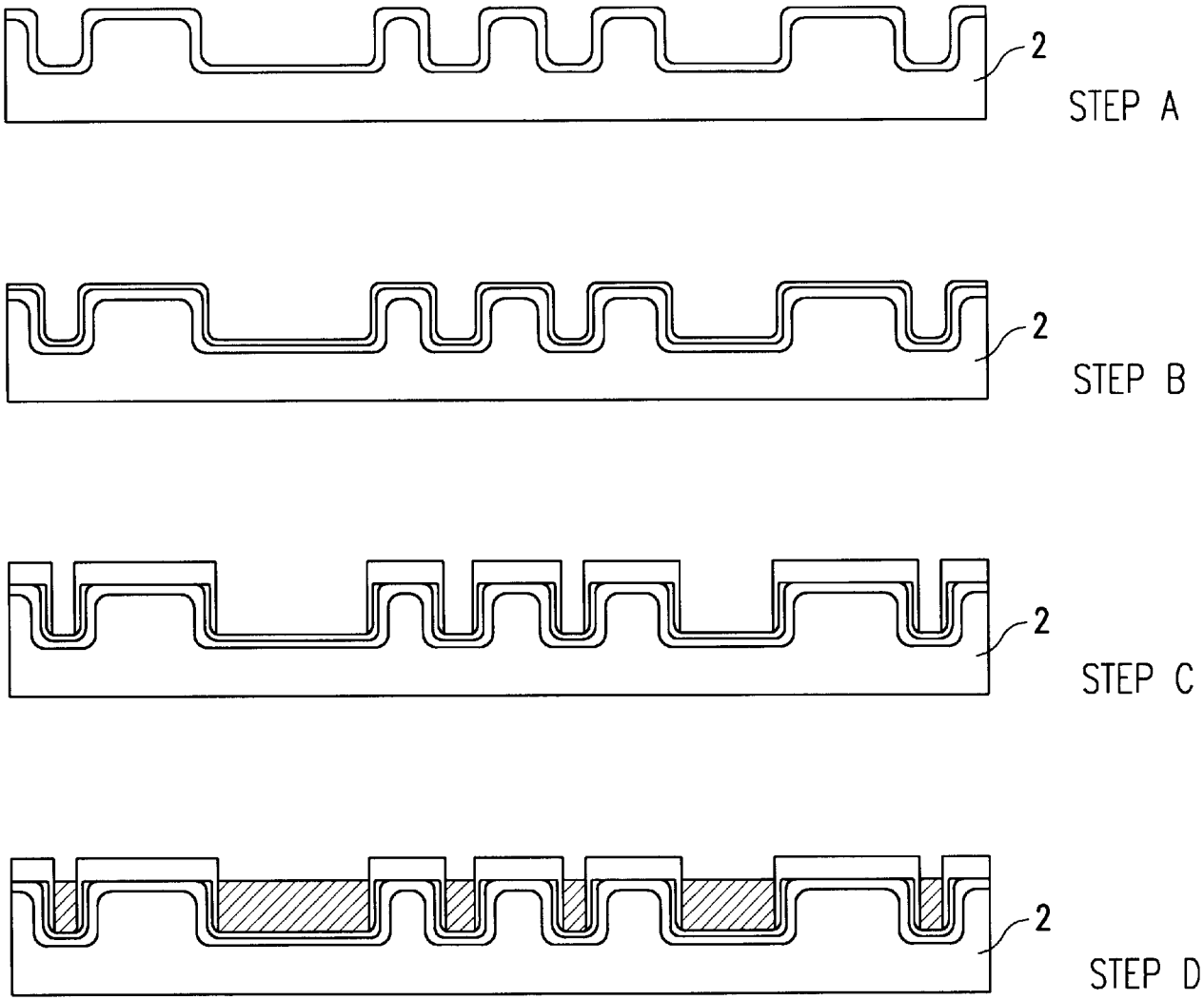
FIGS. 16A and 16N are cross-sectional views of the preferred fabrication stages for the embodiment of the present invention shown in FIG. 15A, taken along the cantilever beam in FIG. 15A.
Figure 16E:
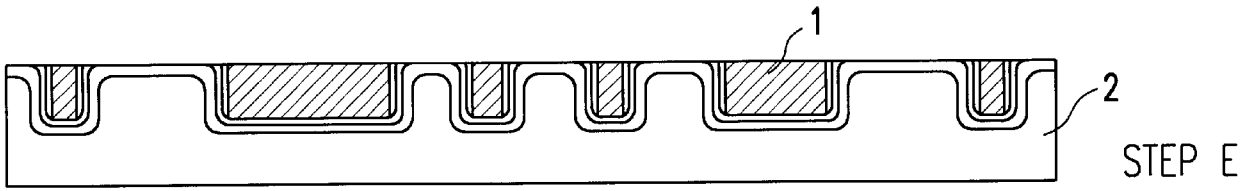
Figure 16F:
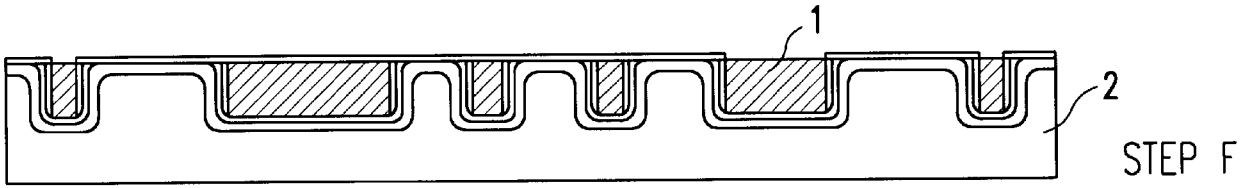
Figure 16G:
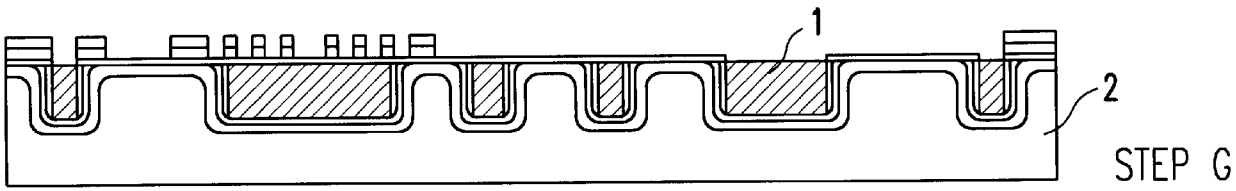
Figure 16H:
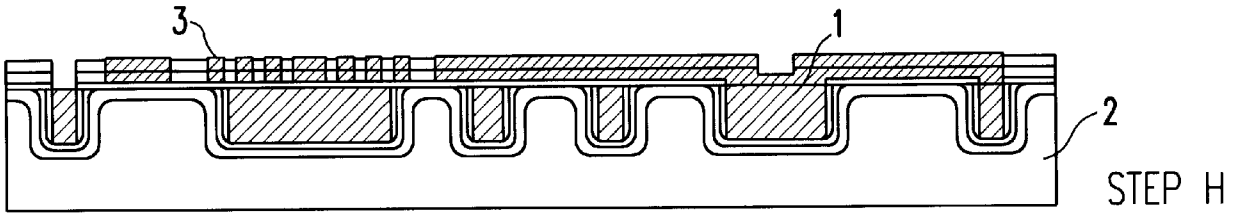
Figure 16I:
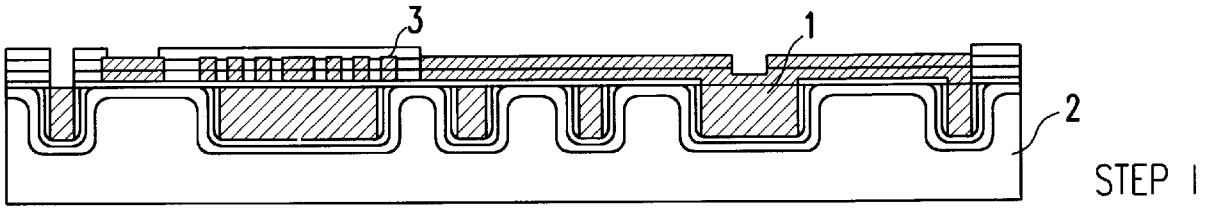
Figure 16J:
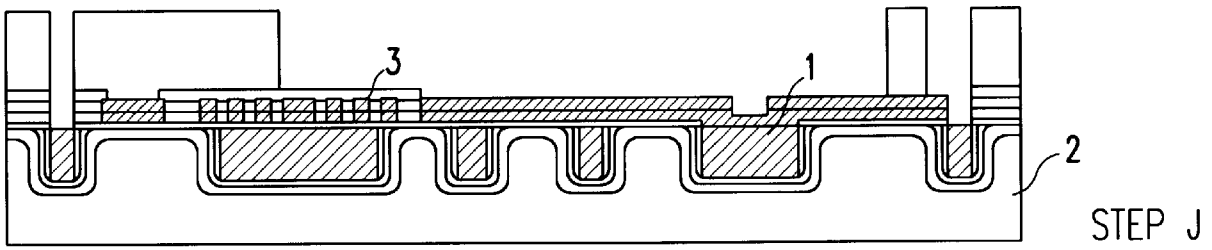
Figure 16K:
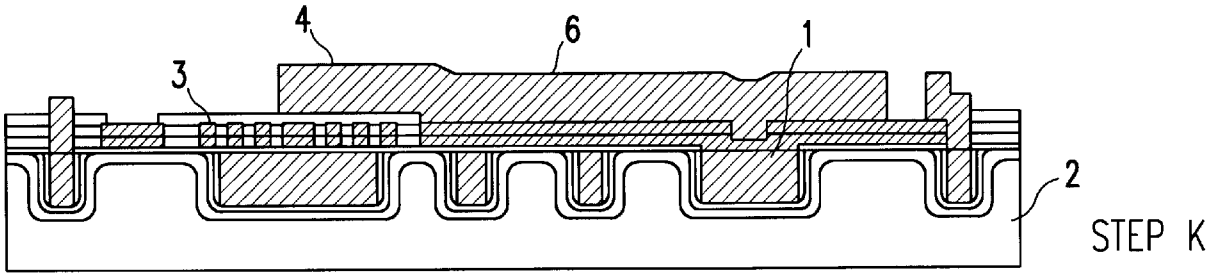
Figure 16L:
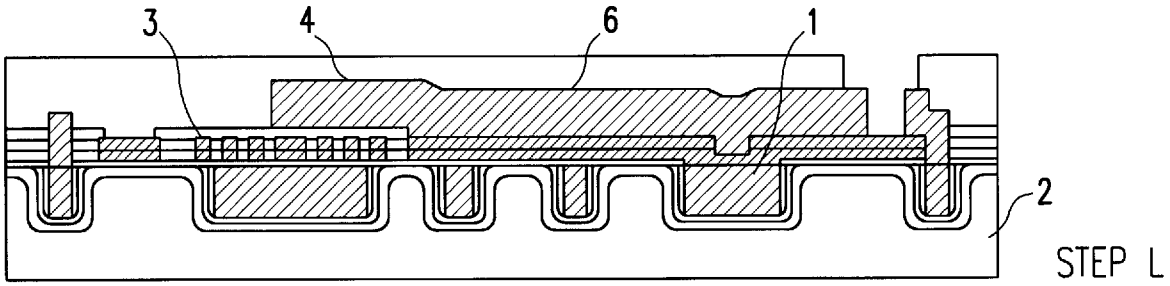
Figure 16M:
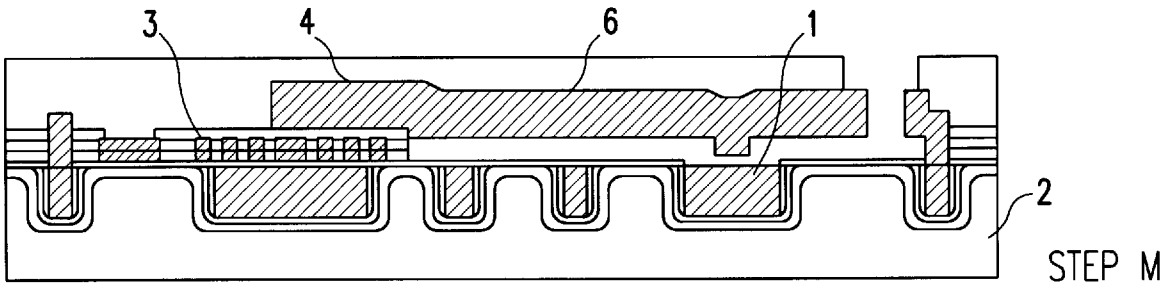
Figure 16N:
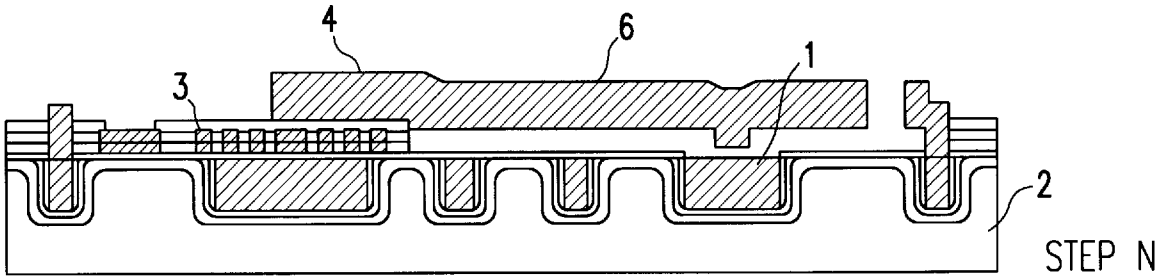

FIGS. 16A and 16N are cross-sectional views of the preferred fabrication stages for the embodiment of FIG. 15A, taken along the cantilever beam 6. The following steps describe stages a) through n) of these sets of figures:

Step a):

Etch, using RIE, into Si substrate 2 about 10 μm (thickness of subsequent permalloy plate) to form a "mold"; use AZ4620 as mask.

Provides an insulating "mold" which is filled by the subsequent plating of the first permalloy plating. The goal is to achieve, after an arbitrary thickness of permalloy is plated, a planar surface, nearly as smooth as that of the virgin silicon wafer. The smoother the resulting surface the more reliable the following steps and structures will be.

Global etch with HNA to round corners.

By rounding the comers, the potential for short circuiting of the subsequent aluminum coil is minimized.

Grow ~1 μm thermal oxide.

Lays down an insulating layer to keep any permalloy used in the electrical circuit from short circuiting.

Step b):

Evaporate Cr/Cu/Cr (100 Å/1000 Å/100 Å) seed layer.

Lays down a plating seed layer which adheres well to the substrate and is compatible with permalloy plating.

Step c):

Create mold with Ultra-baked AZ4620.

Produces a plating mold of permanent, insulating material. Photoresist is used due to its easy patterning characteristic.

Step d):

Mold plate about 10 μm (same thickness as Si recess depth in first step) of NiFe (permalloy).

Selectively plates soft magnetic material with very high permeability for first layer 1 of magnetic circuit up through a mold.

Step e):

$O_2$ plasma ash ultra-baked mold PR back to Cr/Cu/Cr, leaving ultra-baked PR in any crevasses around the plated structures; strip exposed Cr/Cu/Cr.

Removes excess insulating material from surface of substrate in such a way to maximize planarization. Removes unused sections of the seed layer to electrically insulate permalloy structures.

Step f):

Coat with PI and ultra-bake.

Lays down a thin layer of material to electrically insulate the first layer of permalloy and the subsequent aluminum coils. Beneficial if material can also act as a mechanical separation between layers and is highly resistant to subsequent processing steps.

OPTIONAL: $O_2$ plasma ash back to $SiO_2$/NiFe level to fill any remaining crevasses areas between $SiO_2$ and NiFe.

Intended to improve planarization if needed.

OPTIONAL: Coat with PI and Ultra-bake.

Needed if previous optional step is executed.

Pattern PI with $O_2$ plasma using AZ as mask.

Strip AZ with global UV and developer.

$O_2$ plasma thin PI to desired thickness.

Opens access windows through insulator to allow access to underlying permalloy or substrate as needed.

Step g):

Create "mold" with ultra-baked PR for coil/sacrificial.

Lays down and patterns a layer of insulating material that is the same thickness as, and a negative image of, the aluminum coils deposited in subsequent steps; done before aluminum is deposited to improve planarization.

Step h):

Evaporate Al layer that is thicker than desired gap of switch.

Deposits material that can act as both electrical coil and as a sacrificial layer for freeing the subsequent permalloy cantilever beam.

Pattern through fall thickness of Al to create coils 3 and sacrificial areas.

OPTIONAL: pattern divots into Al to a depth that is equal to Al_thickness —Desired_Gap_distance.

Creates planar coils 3 and sacrificial pads.

OPTIONAL: explicitly define contact point sizes and locations as well as gap distance.

Step i):

Create insulating layer of PI.

If too thin or surface non-planar, can do second coat.

Lays down layer to electrically insulate Al structures and to planarize surface.

Step j):

Evaporate Cr/Cu/Cr seed layer (100 Å/100 Å/100 Å).

Create mold with AZ4620 (>10 μm)—soft baked only.

Produces an easily removable plating mold.

Step k):

Plate about 10 μm NiFe.

See step d)—second layer 4 of magnetic circuit with integrated free standing structure 6.

Strip PR mold with global UV and developer.

Strip seed layer.

Removes mold and seed layer to isolate second layer permalloy, both electrically and mechanically.

Step l):

PR pattern with sacrificial etch mask.

Lays down easily removable material which is resistant to the etchant used to remove the sacrificial material and which can protect the devices from debris generated during dicing.

Step m):

Dice.

Separate substrate into individual devices.

Etch sacrificial Al with 1% HF.

Removes sacrificial material to produce free standing structures without damaging the other materials in the device.

Step n):

Strip protective PR with global UV and developer.

Removes sacrificial mask layer and dry devices so as to avoid any difficulties with stiction.

E. Fifth Process—Double-Sided Design

Figure 17A:
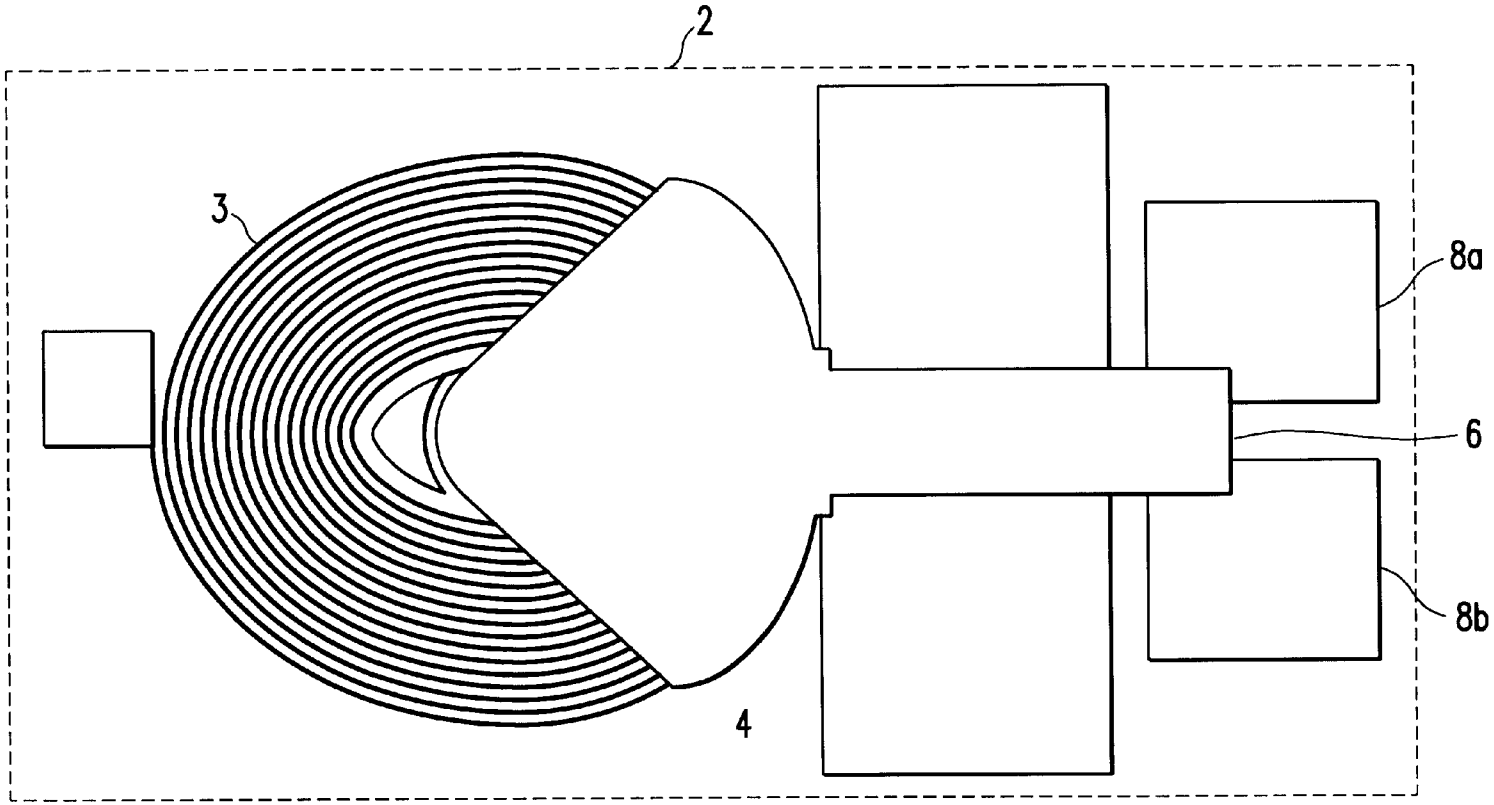
FIG. 17A is top view of an alternative embodiment of the present invention, showing a double-sided fabrication switch design.
Figure 17B:
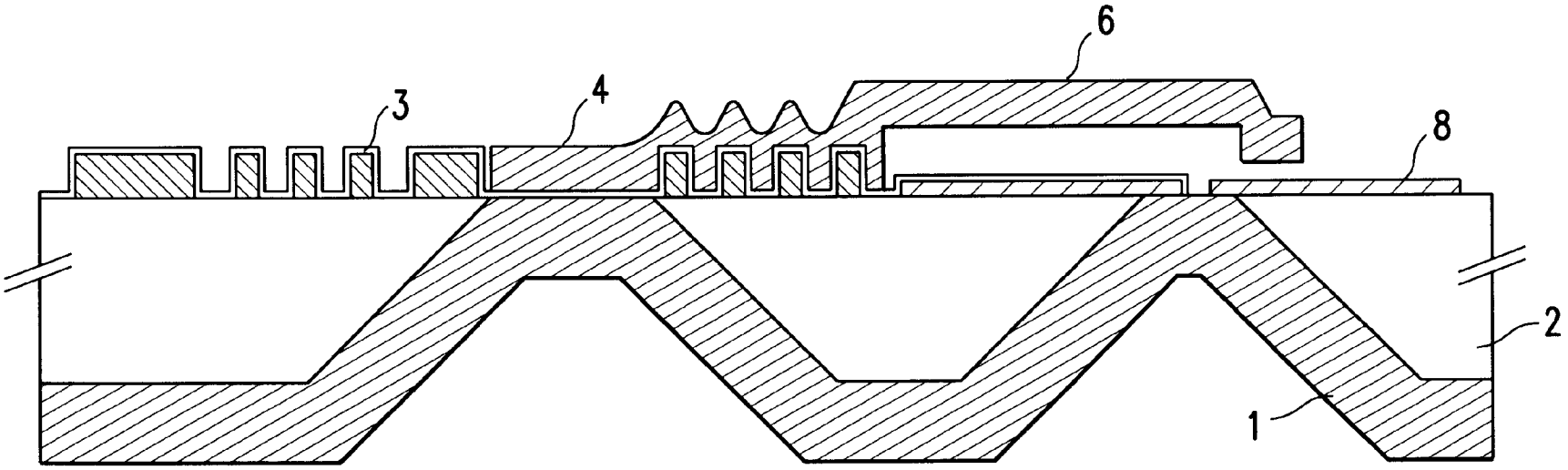
FIG. 17B is a cross-sectional view of the structure in FIG. 17A, taken along the cantilever beam in FIG. 17A.
Figures 18A, 18B, 18C, 18D, 18E:
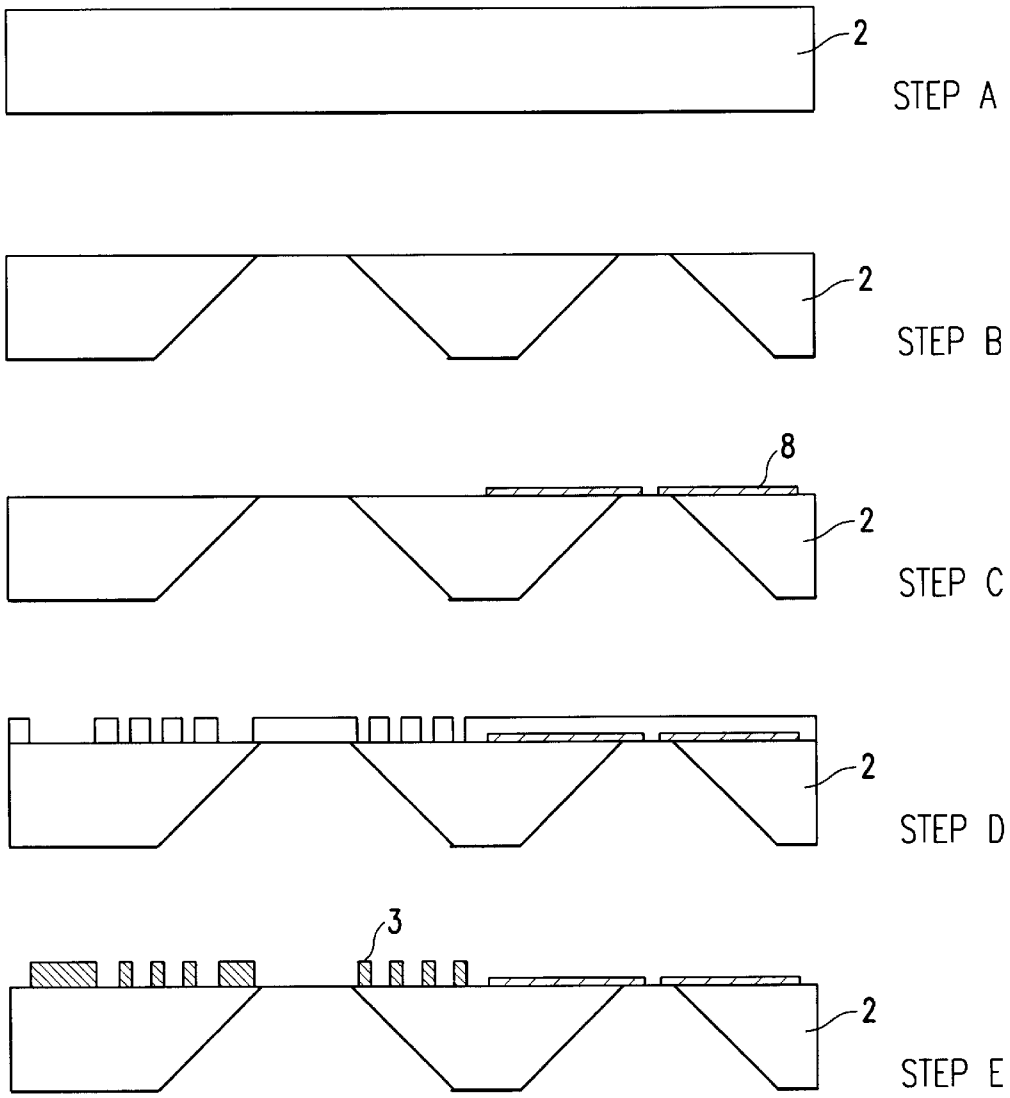
FIG. 18A–18K cross-sectional views of the preferred fabrication stages for the embodiment of the present invention shown in FIG. 1 7A, taken along the cantilever beam in FIG. 17A.
Figure 18F:
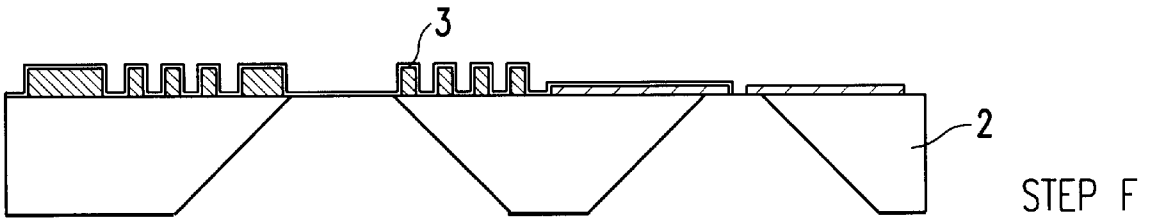
Figure 18G:
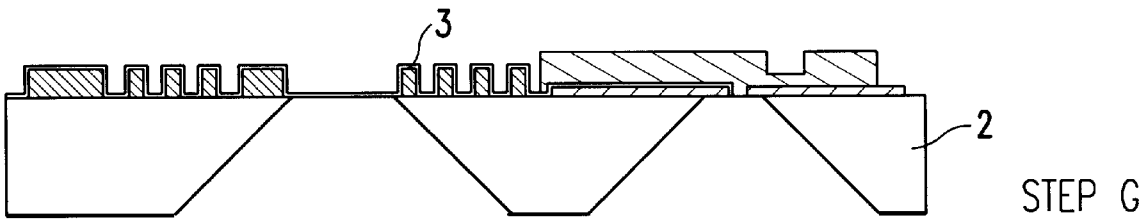
Figure 18H:
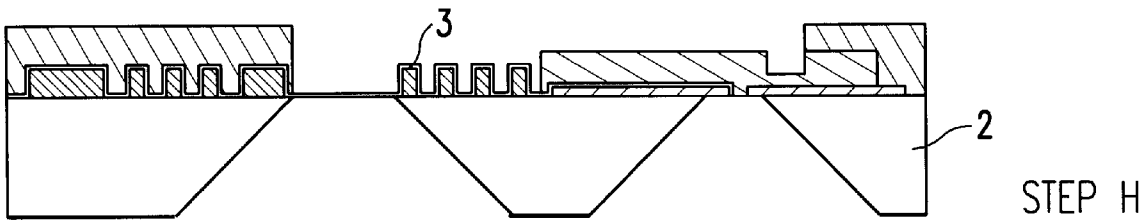
Figure 18I:
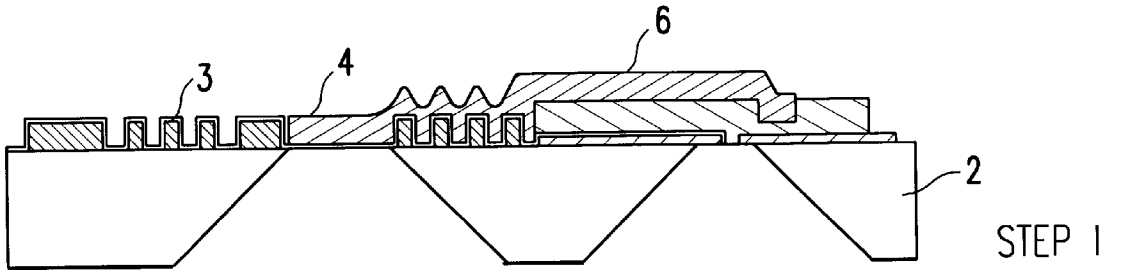
Figure 18J:
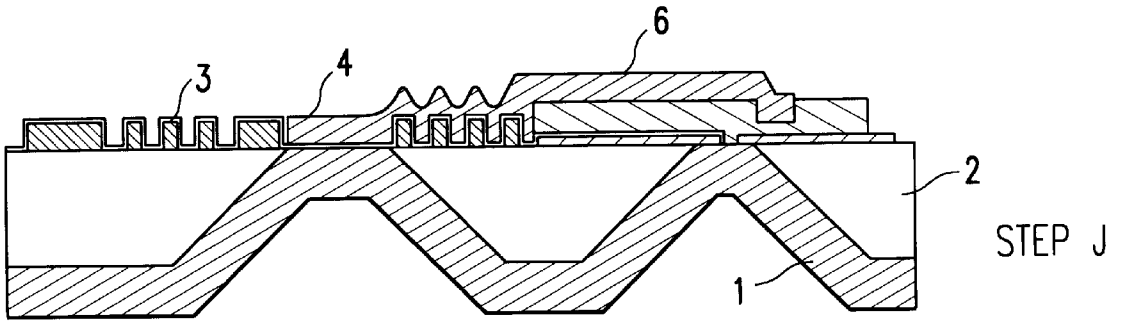
Figure 18K:
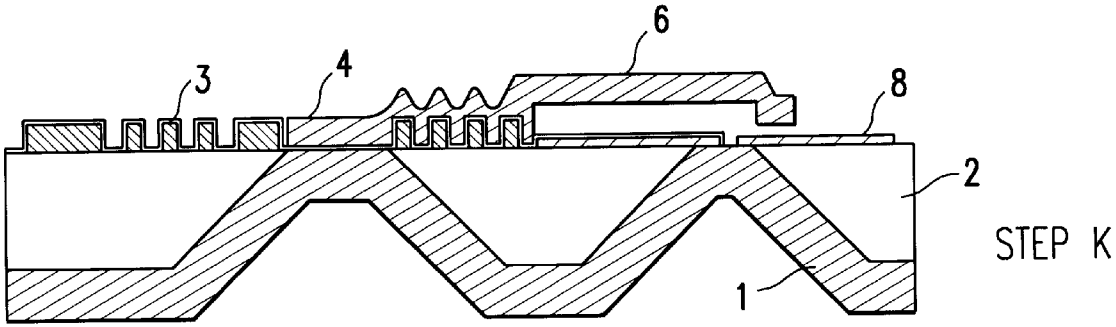

FIG. 17A is top view of another alternative embodiment of the present invention, showing a single coil design but with structures formed on both the top and bottom of the substrate 2. FIG. 17B is a cross-sectional view of the structure in FIG. 17A, taken along the cantilever beam 6. FIGS. 18A–18K are cross-sectional view of the preferred fabrication stages for the embodiment of FIG. 17A, taken along the cantilever beam 6. The following steps describe stages a) through k) of this set of figures:

Step a):

Start with silicon substrate 2 coated with insulator on both sides of wafer.

Choose silicon for convenience and for the potential to integrate electronic circuitry into the switch. In general, almost any material can be used for the substrate as long as it is compatible with the following processes. Possible examples are printed circuit boards, glass, ceramics, plastics, etc.

Insulation is required so the subsequently deposited electromagnetic coil will not be short circuited. While almost any insulating material can be used, nitride or oxide is most suitable for the silicon substrate.

Step b):

On the back side of the substrate 2, open etching windows through the insulator to expose the silicon. Using an anisotropic etchant such as potassium hydroxide (KOH), ethylene diamine pyrochatecol (EDP) or TMaH, etch through the full thickness of the substrate. The etch stops when it reaches the insulator on the front side of the wafer, forming it into a thin membrane.

In this process, the thickness of the substrate insulates the two magnetic layers from interaction from one another, reducing losses due to stray fields. The holes through the wafer provides the magnetic flux path of the design which produces the actuating force in the switch.

Anisotropic etch is chosen to form the through-holes due to convenience of access and use and its applicability to silicon processing. The holes could also be formed by RIE, drilling or other technique. If a substrate other than silicon is employed, many other options are possible. The requirement is selective placement of the holes and control of the ultimate size of the opening seen at the front side of the wafer.

Step c):

Evaporate Cr/Au (100 Å/5000 Å). Pattern this into an electrostatic hold electrode and stationary contact point (s) 8.

Lays down and patterns a highly conductive layer which adheres well to the substrate. Cr/Au is used at present for convenience but it is likely that this will change to a material (alloy or composite) which is more commonly used in mechanical relays and results in longer operational life time for the device.

Step d):

Evaporate Cr/Cu/Cr (100 Å/1000 Å/100 Å) electroplating seed layer. On top of this layer, create a mold with soft-bake AZ4620.

Lays down a plating seed layer which adheres well to the substrate and is compatible with copper plating.

Produces an easily removable plating mold. Photoresist is used due to its easy patterning characteristic.

Step e):

Mold plate 5 to 10 μm of copper. After plating, remove the photoresist mold. Strip the electroplating seed layer, being careful to minimize etching of the plated structures.

Selectively plates material with very high electrical conductance to form the electromagnetic coil 3.

Step f):

Deposit a conformal, electrically insulating layer of material. Pattern the layer to provide access windows to bond pads and contact points for the electromagnetic coil 3, the hold electrode and the stationary contact points 8.

Insulates the electromagnetic coil, the hold electrode and the stationary contact points. This prevents subsequently deposited metal layers from short circuiting these structures as well as electrically insulating them from said layers.

Most any insulating material that is not attacked by acetone can be used. These include, but are not limited to, oxide, nitride, Teflon, polyimide and ultra-baked photoresist.

Step g):

Spin on and pattern photoresist to act as a sacrificial spacer layer.

Lays down a thick (5 to 10 μm) layer of material which can act as a sacrificial material. While photoresist is not the only available material, it has been chosen for its ease of use, compatibility with subsequent steps, and ease of removal. Some other candidate materials are aluminum and copper.

Photoresist has the added benefit that it can be laid down in several layers. Arbitrary thicknesses can be achieved. Each layer can be patterned separately to achieve desired effects such as dimpling the contact portion of the cantilever beam 6.

Step h):

Evaporate Cr/Cu/Cr (100 Å/1000 Å/100 Å) electroplating seed layer. On top of this layer, create a mold with soft-bake AZ4620.

Lays down a plating seed layer which adheres well to the substrate and is compatible with permalloy plating.

Step i):

Mold plate 5 to 10 μm of permalloy. After plating, remove the photoresist mold. Strip the electroplating seed layer.

Selectively plate a material with soft magnetic properties and very high permeability to form the top layer 4 of the device's magnetic circuit. This plating also forms a cantilever beam 6 which will ultimately become free standing.

Plating of permalloy is chosen for ease of deposition and resulting excellent magnetic properties. Additional deposition techniques and materials may be used. These include, but are not limited to, sputtering of most any magnetic material or silk screening of magnetic particles suspending in a polyimide matrix.

Step j):

Evaporate Cr/Cu/Cr (100 Å/100 Å/100 Å) electroplating seed layer onto back side of wafer. Global plate very thick (>10 μm) layer of permalloy.

Forms bottom layer 1 of the device's magnetic circuit. See step i) for explanation of choice of permalloy and alternative techniques.

Note that this layer is a global deposition with no patterning. It is believed that separating the two magnetic layers by the thickness of the wafer will make patterning unnecessary. However, a patterning step, either with etch back or mold plating, can be added if it is found that the magnetic isolation provided by physical separation is insufficient.

Step k):

Strip sacrificial photoresist.

Strip sacrificial material from beneath the top magnetic cantilever beam to produce a free standing structure without damaging the other materials in the device. Acetone or dedicated photoresist stripper may be used.

Alternative Beam Designs

In the preferred embodiment, the inventive micro-relay requires proper design of its cantilever beam. The cantilever performs two primary functions. First, it defines the electromagnetic force that must be generated to close the relay. Secondly, it is part of the magnetic flux path in the magnetic circuit. The two properties need to be balanced. A beam with larger cross-sectional area provides a flux path with lower magnetic resistance and reduces losses due to stray fields. A larger beam also means that a greater magnetic force is required to close the relay. Thus, too large a beam and the relay cannot be closed; too small a beam and the magnetic resistance of the beam overwhelms the magnetic circuit and no electromagnetic force is generated, and again the relay will not close.

The most straightforward design, in terms of fabrication, is a normal cantilever beam. This is a single strip of magnetic material that is formed into a free-standing structure, as shown in FIG. 1A, for example. For proper operation, this design option requires delicate balancing between the flux and bending force properties of the beam. This is possible but can limit the design possibilities. Of the two cantilever design options, this design lends itself most strongly to a single contact point design in which the switched current flows the length of the beam. It can also be used equally well in the double contact design in which the current flows across the end of the beam.

Figure 19A:
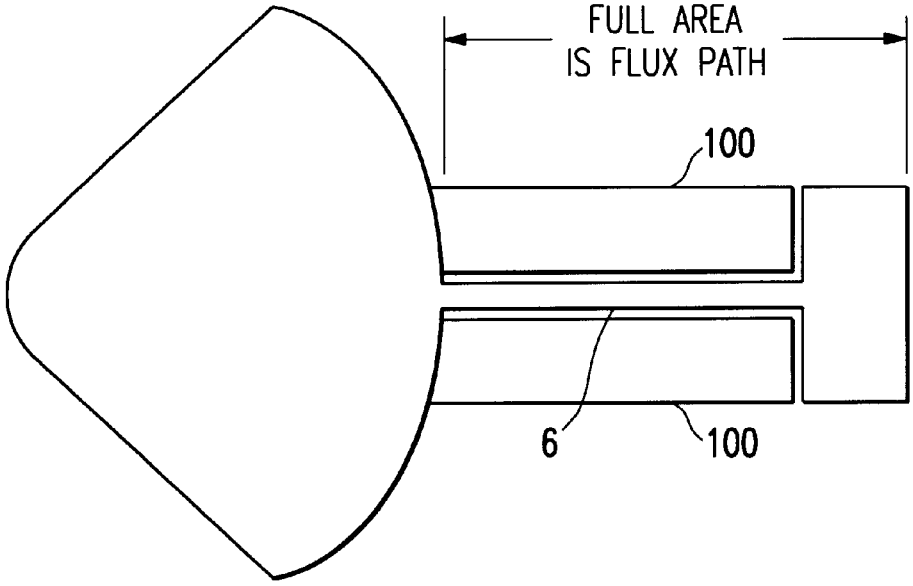
FIGS. 19A and 19B are top views of alternative cantilever beam designs in which the flux path and bending force properties can be designed separately.
Figure 19B:
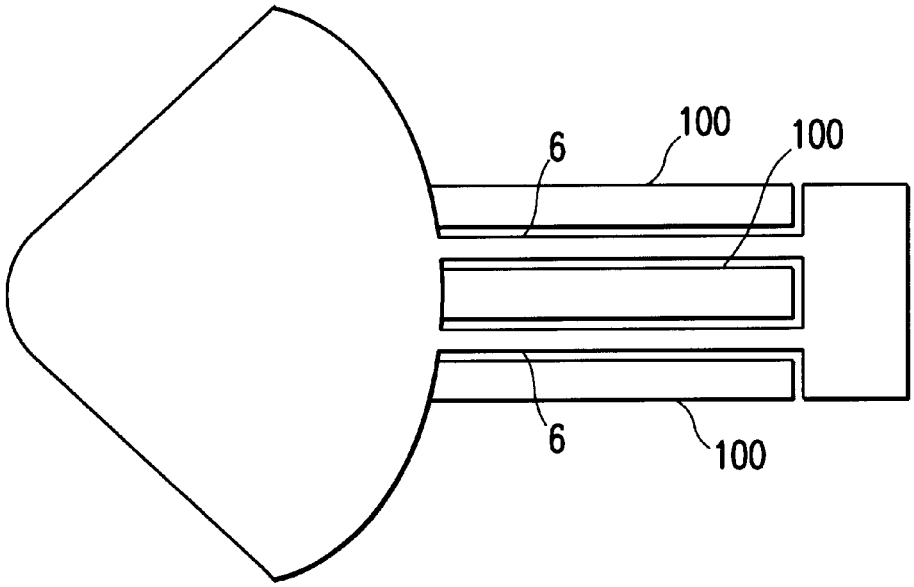

A second design produces a cantilever beam in which the flux path and bending force properties can be designed separately. Two examples of this second design are shown in FIGS. 19A and 19B. Key to this design is the addition of at least two magnetic strips 100 running parallel to the cantilever beam 6. These strips 100 are formed at the same time as the cantilever beam 6. They are placed in close proximity to, but physically isolated from, the beam 6. The strips 100 become the main flux path in the magnetic circuit, making the magnetic resistance of the cantilever beam 6 unimportant. This allows the cantilever beam 6 to be designed separately so as to optimize its bending forces. Both the width and the thickness of the beam 6 can become parameters in the bending force design without having to worry about the affect of these parameters would normally have on the overall magnetic circuit. This design lends itself most strongly to the double contact design in which switched current flows across the end of the beam 6. (That is, because this design will most likely result in reducing the cross sectional area of the beam 6, its electrical resistance will typically be large. This may mean that this design option may not lend itself to a single contact point design in which the current flows the length of the beam.)

Conclusion

Important aspects of the present invention include:

the switched current path can be isolated from or integrated with the magnetic circuit;

multiple coils, stacked or spread out (in parallel planes or co-planar) can be fabricated;

low temperature electroplating fabrication processes allow integration with integrated circuits, fabrication on low-cost substrates (e.g., glass, metal, magnetic materials, printed circuit boards, etc.), and low fabrication costs;

complete integration of all switch components (no assembly required); and fabrication of multiple micro-relays on the same die/device, allowing circuit interconnections of relays.

Possible applications for the inventive micro-relay are very extensive. The micro-relay will be able to act as a one-to-one replacement in areas where traditional electromechanical relays are presently being used. Micro-relays capable of carrying low current loads will be extremely useful in communications type circuitry. While transistors can carry similar loads at similar and ever lower cost, the "ideal" electrical nature of micro-relays make it possible to implement circuit configurations excluded by the operational properties of transistors. For example, passing of AC signals can be implemented with a single micro-relay whereas two transistors or a special silicon device would need to be used. Micro-relays in accordance with the present invention with current carrying capabilities in the range of 1 to 3 amps will be able to switch normal home appliances and computer equipment. Because of the small size of the inventive relay, potentially enormous market in the area of remote-controlled or "intelligent" houses are opened. Standardized micro-relays built either into appliances themselves or incorporated in wall sockets could allow all electrical devices (e.g., lights, stereo equipment, etc.) to be controlled by a central computer. If the life-time of micro-relays can be extended to be significantly longer than present day relays, they potentially could be used in switching power supplies that could be 99%+ efficient. Such supplies presently use transistors or MOSFETs and the resistances and costs of such solid state devices are one of the limiting factors on the performance of such power supplies. If micro-relays which are capable of switching 20 to 30 amps are designed, applications in products that require the control of high power can be targeted. One such large market is the automobile industry which use a large number of relays in each automobile to control such things as headlights, windshield wipers, air conditioning, power seats, etc. Finally, with the integration of circuitry, a panel of micro-electromechanical relays could replace a home's circuit breaker panel providing for a more accurate, more efficient, and smaller option than available at present. In short, the invention can be used in a line of micro-relays whose current carrying capability ranges from microamps to tens of amps and which have a potential application in almost every single electrical device being produced today.

A number of embodiments of the present invention have been described. Nevertheless, it will be understood that various modifications may be made without departing from the spirit and scope of the invention. For example, other etchants, metals, mask materials, etching methods, etc., may be used in place of the specific materials and methods described above. Other dimensions for plating thicknesses, mold sizes, etc. can also be used to achieve desired performance or fabrication parameters. Further, some specific steps may be performed in a different order to achieve similar structures. Furthermore, the inventive structures shown above define a "normally open" micro-relay. By forming contacts on top of the cantilever beam 6 and defining the electrical contacts 8 to overhang a portion of the cantilever beam 6, the micro-relay can be used in a "normally closed" mode, where application of current to the coil 3 is necessary to open the circuit by pulling the cantilever beam 6 away from the overlying electrical contacts 8. Also, while the preferred embodiment uses explicitly defined magnetic circuit return paths, partial magnetic circuit return paths may be used as well. Accordingly, it is to be understood that the invention is not to be limited by the specific illustrated embodiment, but only by the scope of the appended claims.

What is claimed is:

1. A method for fabricating a micro-electromechanical relay by the steps of:

(a) forming, by micro-machining techniques, at least one magnetic circuit;

(b) forming, by micro-machining techniques, a mold structure defining at least one location for at least one electromagnetic coil;

(c) depositing within the mold structure, by micro-machining techniques, a conductive material in sufficient quantity to build up at least one integral electromagnetic coil for interacting with at least one magnetic circuit when electricity is applied to at least one electromagnetic coil;

(d) forming, by micro-machining techniques, at least one magnetically deflectable structure deflectable by a magnetic force generated by at least one magnetic circuit in response to the application of electricity to at least one electromagnetic coil so as to switch electricity upon such deflection.

2. The method of claim 1, wherein at least one electromagnetic coil is planar.

3. The method of claim 1, wherein at least one electromagnetic coil is a solenoid.

4. The method of claim 1, wherein at least one magnetic circuit is formed of magnetic material having high magnetic permeability.

5. A method for fabricating a micro-electromechanical relay comprising the steps of:

(a) forming, by micro-machining techniques, at least one first layer of magnetic material on a substrate;

(b) forming, by micro-machining techniques, a mold structure defining at least one location for at least one electromagnetic coil;

(c) depositing within the mold structure by micro-machining techniques, a conductive material in sufficient quantity to build up at least one integral coil magnetically coupled with at least one first layer;

(d) forming, by micro-machining techniques, at least one electrical contact for conducting current through the relay; and (e) forming, by micro-machining techniques, at least one second layer of magnetic material, in magnetic circuit with at least one first layer and at least one coil, a part of at least one second layer defining at least one deflectable structure, each deflectable structure being deflectable towards at least one first layer when electricity is applied to at least one coil, at least one deflectable structure including an electrically conductive portion for conducting electricity through at least one of the electrical contacts to transition the relay between an open state and a closed state, and wherein the magnetic material of at least one of the first layer and second layer has high magnetic permeability.

6. The method of claim 5, wherein the magnetic material having high magnetic permeability is permalloy.

7. The method of claim 5, wherein at least one deflectable structure spans, and conducts electricity between, two electrical contacts when the relay is in the closed state.

8. The method of claim 5, including the further step of forming the conductive portion of at least one deflectable structure so as to be electrically isolated from such deflectable structure.

9. The method of claim 5, wherein electricity conducts along at least one deflectable structure to at least one electrical contact when the relay is in the closed state.

10. The method of claim 5, further including the step of forming at least one capacitor, in part from at least one deflectable structure, for electrostatically holding, upon activation, the electrically conductive portion of at least one deflectable structure in a selected one of the open and closed states without application of electricity to any coil.

11. The method of claim 5, wherein at least one coil is planar.

12. The method of claim 5, wherein at least one coil is a solenoid.

13. The method of claim 5, wherein an end of at least one coil is connected to an electrical power source through at least one first layer.

14. The method of claim 5, wherein at least one second layer contacts at least one first layer through the interior of at least one coil.

15. The method of claim 5, wherein each electrical contact includes conductive contact bumps to provide more reliable contact points.

16. A method for fabricating a spark suppressor micro-electromechanical relay having at least one electrical contact and a deflectable structure at least a portion of which is deflected with respect to at least one electrical contact when the relay is activated, the deflectable structure including an electrically conductive portion for conducting electricity through at least one of the electrical contacts to transition the relay between an open state and a closed state, the method comprising the step of:

(a) forming, by micro-machining techniques, at least one micro-lightning rod of conductive material on the deflectable structure such that at least one micro-lightning rod is situated with respect to each electrical contact so as to electrically interact with each contact before the electrically conductive portion of the deflectable structure makes contact with such electrical contacts during transitions of the relay between the open state and the closed state.

17. A method for fabricating a spark suppressor micro-electromechanical relay having at least two electrical terminals, at least one electrical contact each coupled to at least one electrical terminal, and a deflectable structure at least a portion of which is deflected with respect to at least one electrical contact when the relay is activated, the deflectable structure including an electrically conductive portion for conducting electricity through at least one of the electrical contacts to transition the relay between an open state and a closed state, the method comprising the steps of:

(a) forming, by micro-machining techniques, at least one first micro-lightning rod of conductive material electrically connected to a first one of the electrical terminals;

(b) forming, by micro-machining techniques, at least one second micro-lightning rod of conductive material electrically connected to a second one of the electrical terminals;

wherein at least one first micro-lightning rod is spaced from at least one second micro-lightning rod so as to form a spark gap.

18. A micro-electromechanical relay formed by micro-machining techniques and including at least one magnetic circuit, at least one integral electromagnetic coil, fabricated by forming, by micro-machining techniques, a mold structure defining at least one location for at least one electromagnetic coil and depositing within the mold structure, by micro-machining techniques, a conductive material in sufficient quantity to build up such at least one integral coil, for interacting with at least one magnetic circuit when electricity is applied to at least one electromagnetic coil, and at least one magnetically deflectable structure deflectable by a magnetic force generated by at least one magnetic circuit in response to the application of electricity to at least one electromagnetic coil so as to switch electricity upon such deflection.

19. The relay method of claim 18, wherein at least one electromagnetic coil is planar.

20. The relay of claim 18, wherein at least one electromagnetic coil is a solenoid.

21. The relay of claim 18, wherein at least one magnetic circuit is formed of magnetic material having high magnetic permeability.

22. A micro-electromechanical relay comprising:

(a) at least one first layer of magnetic material formed on a substrate by micromachining techniques;

(b) at least one integral coil magnetically coupled with at least one first layer and fabricated by forming, by micro-machining techniques, a mold structure defining at least one location for at least one electromagnetic coil and depositing within the mold structure, by micro-machining techniques, a conductive material in sufficient quantity to build up such at least one integral coil;

(c) at least one electrical contact for conducting current through the relay and formed by micro-machining techniques; and (d) at least one second layer of magnetic material, in magnetic circuit with at least one first layer and at least one coil and formed by micro-machining techniques, a part of at least one second layer defining at least one deflectable structure, each deflectable structure being deflectable towards at least one first layer when electricity is applied to at least one coil, at least one deflectable structure including an electrically conductive portion for conducting electricity through at least one of the electrical contacts to transition the relay between an open state and a closed state, and wherein the magnetic material of at least one of the first layer and second layer has high magnetic permeability.

23. The relay of claim 22, wherein at least one magnetic circuit is formed of magnetic material having high magnetic permeability.

24. The relay of claim 22, wherein at least one deflectable structure spans, and conducts electricity between, two electrical contacts when the relay is in the closed state.

25. The relay of claim 22, wherein the conductive portion of at least one deflectable structure is electrically isolated from such deflectable structure.

26. The relay of claim 22, wherein electricity conducts along at least one deflectable structure to at least one electrical contact when the relay is in the closed state.

27. The relay of claim 22, further including at least one capacitor, formed in part from at least one deflectable structure, for electrostatically holding, upon activation, the electrically conductive portion of at least one deflectable structure in a selected one of the open and closed states without application of electricity to any coil.

28. The relay of claim 22, wherein at least one coil is planar.

29. The relay of claim 22, wherein at least one coil is a solenoid.

30. The relay of claim 22, wherein an end of at least one coil is connected to an electrical power source through at least one first layer.

31. The relay of claim 22, wherein at least one second layer contacts at least one first layer through the interior of at least one coil.

32. The relay of claim 22, wherein each electrical contact includes conductive contact bumps to provide more reliable contact points.

33. A spark suppressor micro-electromechanical relay including:

(a) at least one electrical contact;

(b) a deflectable structure at least a portion of which is deflected with respect to at least one electrical contact when the relay is activated, the deflectable structure including an electrically conductive portion for conducting electricity through at least one of the electrical contacts to transition the relay between an open state and a closed state; and (c) at least one micro-lightning rod of conductive material on the deflectable structure such that at least one micro-lightning rod is situated with respect to each electrical contact so as to electrically interact with each contact before the electrically conductive portion of the deflectable structure makes contact with such electrical contacts during transitions of the relay between the open state and the closed state.

34. A spark suppressor micro-electromechanical relay including:

(a) at least two electrical terminals;

(b) at least one electrical contact each coupled to at least one electrical terminal;

(c) a deflectable structure at least a portion of which is deflected with respect to at least one electrical contact when the relay is activated, the deflectable structure including an electrically conductive portion for conducting electricity through at least one of the electrical contacts to transition the relay between an open state and a closed state;

(d) at least one first micro-lightning rod of conductive material electrically connected to a first one of the electrical terminals;

(e) at least one second micro-lightning rod of conductive material electrically connected to a second one of the electrical terminals;

wherein at least one first micro-lightning rod is spaced from at least one second micro-lightning rod sufficiently to form a spark gap.

* * * * *